US012458110B2

(12) United States Patent
Siegismund

(10) Patent No.: US 12,458,110 B2
(45) Date of Patent: Nov. 4, 2025

(54) ARTICLE OF FOOTWEAR HAVING A CLOSURE SYSTEM

(71) Applicant: PUMA SE, Herzogenaurach (DE)

(72) Inventor: Andreas Siegismund, Rueckersdorf (DE)

(73) Assignee: PUMA SE, Herzogenaurach (DE)

( * ) Notice: Subject to any disclaimer, the term of this patent is extended or adjusted under 35 U.S.C. 154(b) by 305 days.

(21) Appl. No.: 18/198,903

(22) Filed: May 18, 2023

(65) Prior Publication Data

US 2023/0371651 A1 Nov. 23, 2023

Related U.S. Application Data

(60) Provisional application No. 63/343,803, filed on May 19, 2022.

(51) Int. Cl.
*A43C 1/00* (2006.01)
*A43C 11/16* (2006.01)

(52) U.S. Cl.
CPC ..... *A43C 1/00* (2013.01); *A43C 11/165* (2013.01)

(58) Field of Classification Search
CPC ..... A43C 1/00; A43C 11/165; A43C 7/08
See application file for complete search history.

(56) References Cited

U.S. PATENT DOCUMENTS

| | | | | |
|---|---|---|---|---|
| 7,721,468 | B1 * | 5/2010 | Johnson | A43C 1/06 36/118.1 |
| 8,904,672 | B1 * | 12/2014 | Johnson | A43B 11/00 36/58.6 |
| 2005/0198867 | A1 * | 9/2005 | Labbe | A43C 11/14 36/50.1 |
| 2011/0175744 | A1 * | 7/2011 | Englert | A43B 13/189 702/41 |
| 2019/0208855 | A1 * | 7/2019 | Raia | A43C 11/20 |

* cited by examiner

*Primary Examiner* — Haley A Smith
(74) *Attorney, Agent, or Firm* — Quarles & Brady LLP

(57) ABSTRACT

An article of footwear includes an upper, a disc, and a cord. The upper is attached to a sole structure that includes a midsole extending within a heel region of the footwear. The disc defines a first axis. The disc is positioned in the midsole within the heel region and has a first surface with a cord retainer and a second surface with a plurality of teeth, the first surface being perpendicular to the second surface. The cord includes a first end and a second end. A first tension is configured to be applied to the cord. At least one of the first end and the second end of the cord is secured to the cord retainer. When the disc is rotated about the first axis in a first direction, the first tension is applied to the cord.

19 Claims, 19 Drawing Sheets

ARTICLE OF FOOTWEAR HAVING A CLOSURE SYSTEM

CROSS REFERENCE TO RELATED APPLICATIONS

This application claims the benefit of and priority to U.S. Provisional Application No. 63/343,803, filed on May 19, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a closure system, and more specifically, a closure system including a disc heel fastener mechanism.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms. One common closure mechanism to tighten the upper and the tongue onto a user's foot is by using shoelaces. Although shoelaces certainly provide a closure mechanism, shoelaces can break or become untied. Further, shoelaces can become loose over time, and thereby become less aesthetically appealing. Therefore, there is a need for an article of footwear that can selectively provide a tight fit of the upper and the tongue on the user's foot, and selectively provide a looser fit of the upper and the tongue on the user's foot that utilizes no shoelaces.

SUMMARY

An article of footwear, as described herein, may have various configurations. The article of footwear may have an upper and a sole structure connected to the upper.

In some aspects, an article of footwear includes an upper, a plurality of eyelets, a disc, and a cord. The upper is attached to a sole structure which includes a midsole extending within a heel region of the footwear. The disc is positioned in the midsole within the heel region, has a cylindrical shape, and a first axis. The disc has a first surface with a cord retainer and a second surface with a plurality of teeth. The cord has a first end and a second end. A first tension is configured to be applied to the cord. The first surface is perpendicular to the second surface. The at least one of the first end and the second end of the cord is secured to the cord retainer, such that at least one of the first end and the second end of the cord is received within at least one of the plurality of eyelets. When the disc is rotated about the first axis, the first tension is applied to the cord.

In some aspects, an article of footwear includes an upper, a disc, and a cord. The upper is attached to a sole structure that includes a midsole extending within a heel region of the footwear. The disc defines a first axis. The disc is positioned in the midsole within the heel region and has a first surface with a cord retainer and a second surface with a plurality of teeth, the first surface being perpendicular to the second surface. The cord includes a first end and a second end. A first tension is configured to be applied to the cord. At least one of the first end and the second end of the cord is secured to the cord retainer. When the disc is rotated about the first axis in a first direction, the first tension is applied to the cord.

In some embodiments, the plurality of teeth are arranged circumferentially on the disc. In some embodiments, the plurality of teeth extend outwardly from the disc. In some embodiments, the plurality of teeth are exposed externally of the footwear. In some embodiments, when the disc is rotated about the first axis in the first direction, a length of the cord is wrapped about the cord retainer. In some embodiments, the first axis is orthogonal to a central axis that intersects a toe end and a heel end of the footwear. In some embodiments, the cord extends through a plurality of eyelets arranged on the upper.

In some aspects, an article of footwear includes an upper attached to a sole structure, a plurality of eyelets arranged on the upper, a disc, a release mechanism, and a cord. The disc is disposed within a cavity in the sole structure and defines a first axis. The disc has a cord retainer and a plurality of teeth that protrude outwardly from the cavity. The release mechanism is operably connected to the disc. The cord has a first end and a second end, at least one of the first end or the second end of the cord is secured to the cord retainer. When the disc is rotated about the first axis, the cord is configured to adjust a tightness of the footwear.

In some embodiments, the footwear is configured to be unlocked by actuation of the release mechanism. In some embodiments, the release mechanism is disposed in the sole structure. In some embodiments, the release mechanism protrudes from the sole structure. In some embodiments, when the disc is rotated about the first axis in a first direction, the cord is configured to adjust the footwear to a tightened configuration. In some embodiments further rotation of the disc about the first axis in the first direction causes incremental tightening of the footwear. In some embodiments, when the release mechanism is actuated, the disc is configured to be rotated a second direction about the first axis and the footwear is configured to be adjusted to a loosened configuration.

In some aspects, a fastener system for an article of footwear includes a right shoe and a left shoe. The right shoe includes a right disc that is disposed within a sole structure and defines a first axis. The right disc has a cord retainer and a plurality of teeth that protrude outwardly from the sole structure. The right shoe further includes a release mechanism that is operably connected to the right disc and a cord that is operably secured to the cord retainer. The left shoe includes a left disc that is disposed within a sole structure and defines a second axis. The left disc has a cord retainer and a plurality of teeth that protrude outwardly from the sole structure. The left shoe further includes a release mechanism that is operably connected to the left disc and a cord that is operably secured to the cord retainer. When the right disc and the left disc are moved relative to one another, one of the right disc or the left disc is configured to be rotated by engagement with the plurality of teeth of the other of the right disc or left disc, such that a tightness of at least one of the right shoe or the left shoe is adjusted.

In some embodiments, when the right shoe is moved in a rearward direction, the left disc is configured to adjust the tightness the left shoe. In some embodiments, the release mechanism of the left shoe is configured to be actuated to unlock the left disc, and the release mechanism of the right shoe is configured to be actuated to unlock the right disc. In some embodiments, the right disc of the right shoe is configured to be rotated in a first direction about the first axis to adjust the tightness of the right shoe and the left disc of the left shoe is configured to be rotated a second direction about the second axis to adjust the tightness of the left shoe, and the first direction and the second direction are opposite one another. In some embodiments, each of the right disc and the left disc are disposed within a heel region of the sole structure. In some embodiments, the release mechanism of the right disc is disposed in the sole structure and forwardly of the right disc, and the release mechanism of the left shoe is disposed in the sole structure and forwardly of the left disc.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
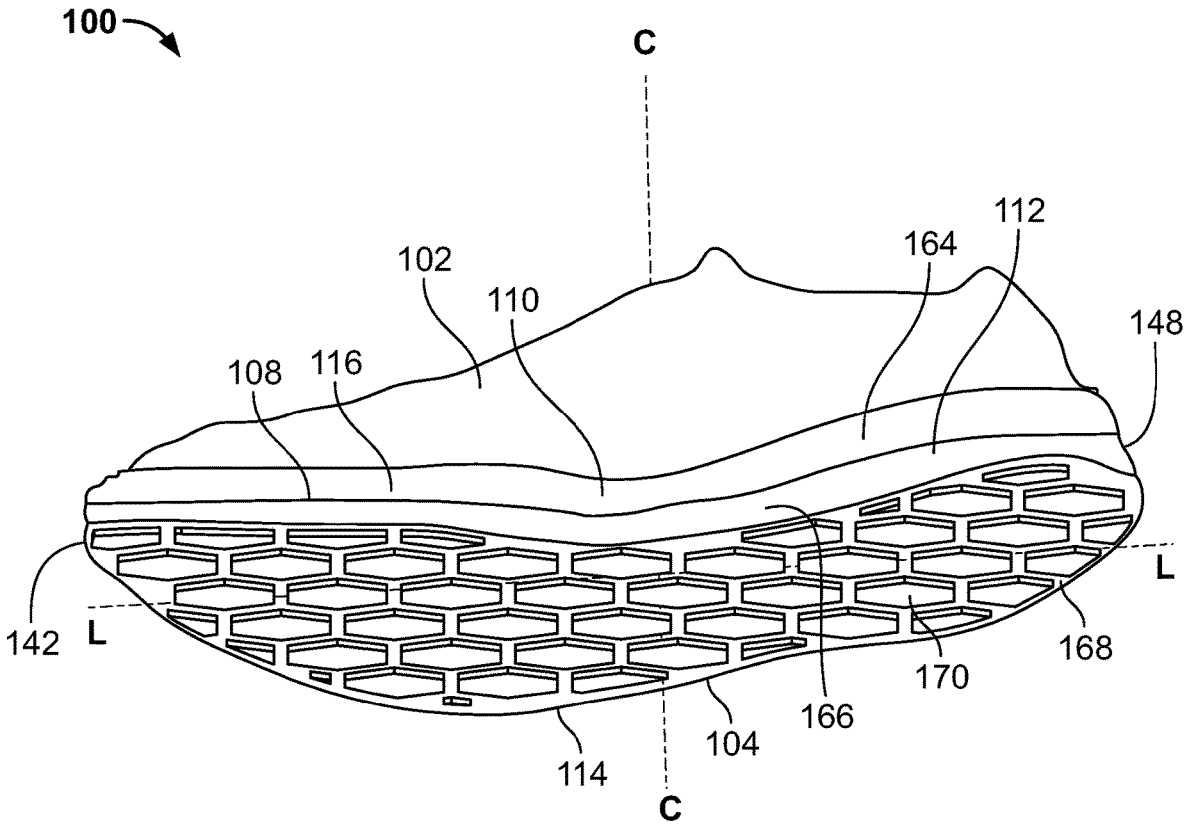
FIG. 1 is a perspective view of a bottom and medial side of an article of footwear configured as a left shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
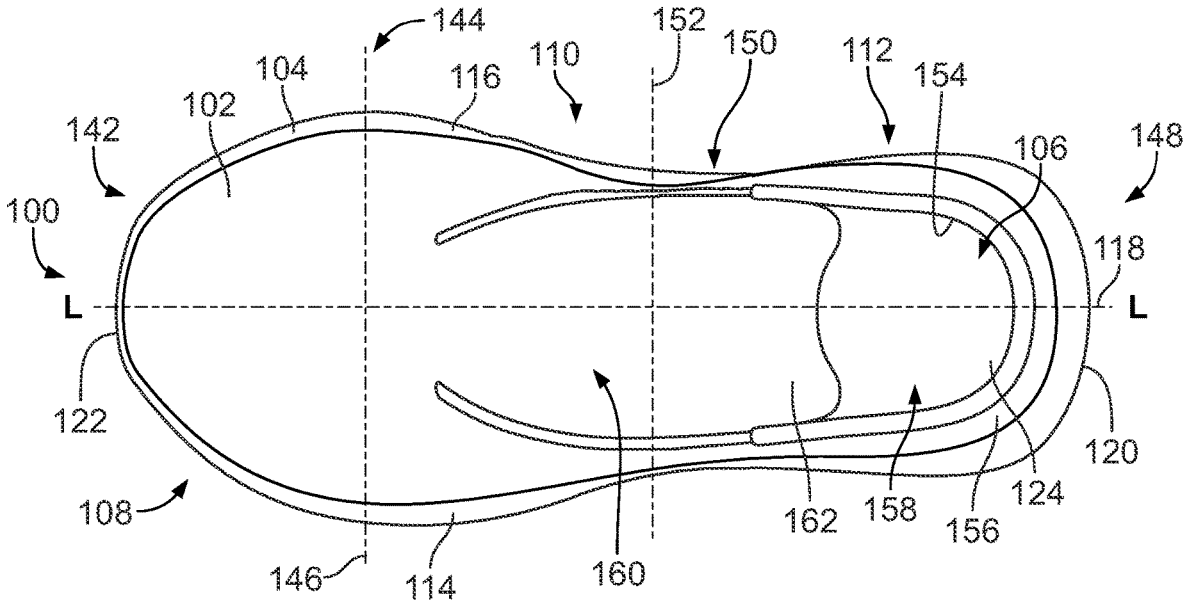
FIG. 2 is a top view of the article of footwear of FIG. 1.
Figure 3:
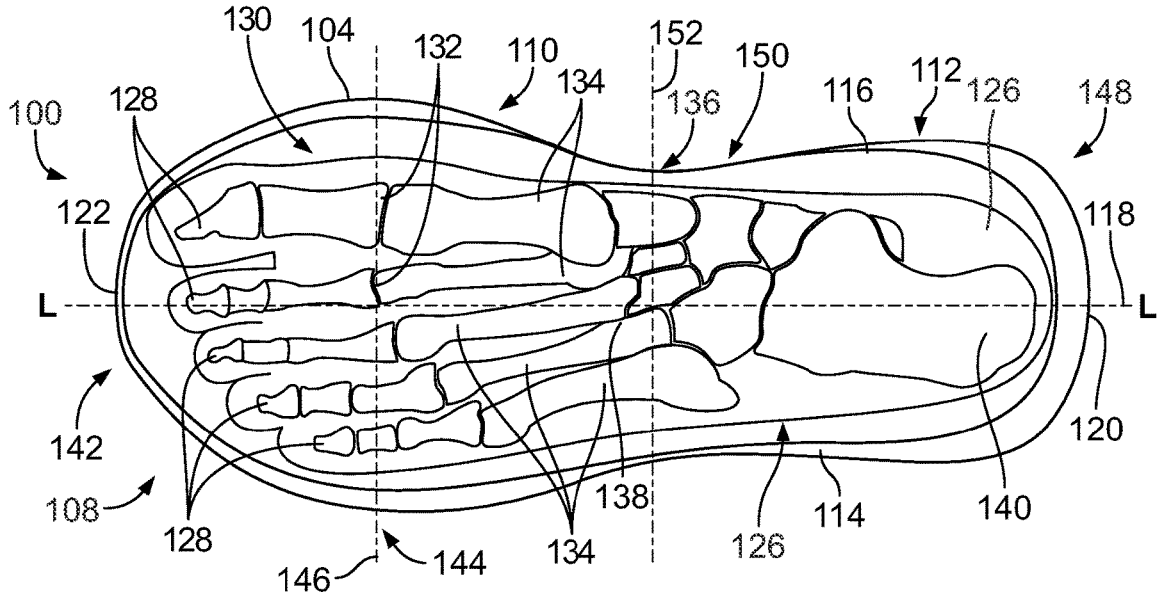
FIG. 3 is a top plan view of the article of footwear of FIG. 1 with the upper removed and a user's skeletal foot structure overlaid thereon.

FIGS. 1-3 depict an exemplary embodiment of an article of footwear 100 including an upper 102 (see FIGS. 1 and 2) and a sole structure 104. The upper 102 is attached to the sole structure 104 and together define an interior cavity 106 (see FIG. 2) into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Referring to FIGS. 1 and 2, with reference to the material (s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

Still referring to FIGS. 1 and 2, in some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Still referring to FIGS. 1 and 2, furthermore, the insole can be positioned within the interior cavity of the upper, which can be in direct contact with a user's foot while an article of footwear is being worn. Moreover, an upper may also include a liner (not shown) that can increase comfort, for example, by reducing friction between the foot of the user and the upper, the sole, the insole, or the like, and/or by providing moisture wicking properties. The liner may line the entirety of the interior cavity or only a portion thereof. In some embodiments, a binding (not shown) may surround the opening of the interior cavity to secure the liner to the upper and/or to provide an aesthetic element on the article of footwear.

Referring to FIGS. 2 and 3, the article of footwear 100 also defines a lateral side 114 and a medial side 116. When a user is wearing the shoes, the lateral side 114 corresponds with an outside-facing portion of the article of footwear 100 while the medial side 116 corresponds with an inside-facing portion of the article of footwear 100. As such, the article of footwear 100 has opposing lateral sides 114 and medial sides 116. The medial side 116 and the lateral side 114 adjoin one another along a longitudinal central plane or central axis 118 of the article of footwear 100, which is coplanar with the longitudinal axis L of FIG. 1. As will be further discussed herein, the central axis 118 may demarcate a central, intermediate axis between the medial side 116 and the lateral side 114 of the article of footwear 100. Put differently, the central axis 118 may extend between a rear, proximal end 120 of the article of footwear 100 and a front, distal end 122 of the article of footwear 100 and may continuously define a middle of an insole 124, the sole structure 104, and/or the upper 102 of the article of footwear 100, i.e., the central axis 118 is a straight axis extending through the rear, proximal end 120 of the heel region 112 to the front, distal end 122 of the forefoot region 108.

Referring to FIG. 3, unless otherwise specified, the article of footwear 100 may be defined by the forefoot region 108, the midfoot region 110, and the heel region 112. The forefoot region 108 may generally correspond with portions of the article of footwear 100 that encase portions of a foot 126 that include a set of toes or phalanges 128, a ball of the foot 130, and a set of joints 132 that connect a set of metatarsals 134 of the foot 126 with the set of toes or phalanges 128. The midfoot region 110 is proximate and adjoins the forefoot region 108. The midfoot region 110 generally corresponds with portions of the article of footwear 100 that encase an arch 136 of the foot 126, along with a bridge 138 of the foot 126. The heel region 112 is proximate to the midfoot region 110 and adjoins the midfoot region 110. The heel region 112 generally corresponds with portions of the article of footwear 100 that encase rear portions of the foot 126, including a heel or calcaneus bone 140, an ankle (not shown), and/or an Achilles tendon (not shown).

Referring to FIGS. 1 and 2, the forefoot region 108, the midfoot region 110, the heel region 112, the medial side 116, and the lateral side 114 are intended to define boundaries or areas of the article of footwear 100. To that end, the forefoot region 108, the midfoot region 110, the heel region 112, the medial side 116, and the lateral side 114 generally characterize sections of the article of footwear 100. Certain aspects of the disclosure may refer to portions or elements that are coextensive with one or more of the forefoot region 108, the midfoot region 110, the heel region 112, the medial side 116, and/or the lateral side 114. Further, both the upper 102 and the sole structure 104 may be characterized as having portions within the forefoot region 108, the midfoot region 110, the heel region 112, and/or along the medial side 116 and/or the lateral side 114. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 116 and/or the lateral side 114.

Referring to FIGS. 2 and 3, the forefoot region 108, the midfoot region 110, the heel region 112, the medial side 116, and the lateral side 114 are shown in detail. The forefoot region 108 extends from a toe end 142 to a widest portion 144 of the article of footwear 100. The widest portion 144 is defined or measured along a first line 146 that is perpendicular with respect to the central axis 118 that extends from a distal portion of the toe end 142 to a distal portion of a heel end 148, which is opposite the toe end 142. The midfoot region 110 extends from the widest portion 144 to a thinnest portion 150 of the article of footwear 100. The thinnest portion 150 of the article of footwear 100 is defined as the thinnest portion of the article of footwear 100 measured across a second line 152 that is perpendicular with respect to the central axis 118. The heel region 112 extends from the thinnest portion 150 to the heel end 148 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 116, and/or the lateral side 114 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 116, and/or the lateral side 114 discussed herein.

Still referring to FIGS. 2 and 3, the medial side 116 begins at the distal, toe end 142 and bows outward along an inner side of the article of footwear 100 along the forefoot region 108 toward the midfoot region 110. The medial side 116 reaches the first line 146, at which point the medial side 116 bows inward, toward the central axis 118. The medial side 116 extends from the first line 146, i.e., the widest portion 144, toward the second line 152, i.e., the thinnest portion 150, at which point the medial side 116 enters into the midfoot region 110, i.e., upon crossing the first line 146. Once reaching the second line 152, the medial side 116 bows outward, away from the central axis 118, at which point the medial side 116 extends into the heel region 112, i.e., upon crossing the second line 152. The medial side 116 then bows outward and then inward toward the heel end 148, and terminates at a point where the medial side 116 meets the central axis 118.

The lateral side 114 also begins at the distal, toe end 142 and bows outward along an outer side of the article of footwear 100 along the forefoot region 108 toward the midfoot region 110. The lateral side 114 reaches the first line 146, at which point the lateral side 114 bows inward, toward the central axis 118. The lateral side 114 extends from the first line 146, i.e., the widest portion 144, toward the second line 152, i.e., the thinnest portion 150, at which point the lateral side 114 enters into the midfoot region 110, i.e., upon crossing the first line 146. Once reaching the second line 152, the lateral side 114 bows outward, away from the central axis 118, at which point the lateral side 114 extends into the heel region 112, i.e., upon crossing the second line 152. The lateral side 114 then bows outward and then inward toward the heel end 148 and terminates at a point where the lateral side 114 meets the central axis 118.

Referring to FIG. 2, the upper 102 extends along the lateral side 114 and the medial side 116, and across the forefoot region 108, the midfoot region 110, and the heel region 112 to house and enclose a foot of a user. When fully assembled, the upper 102 also includes an interior surface 154 and an exterior surface 156. The interior surface 154 faces inward and generally defines the interior cavity 106, and the exterior surface 156 of the upper 102 faces outward and generally defines an outer perimeter or boundary of the upper 102. The upper 102 also includes an opening 158 that is at least partially located in the heel region 112 of the article of footwear 100, which provides access to the interior cavity 106 and through which a foot may be inserted and removed. In some embodiments, the upper 102 may also include an instep region 160 that extends from the opening 158 in the heel region 112 over an area corresponding to an instep of a foot to an area proximate the forefoot region 108. The instep region 160 may comprise an area similar to where a tongue 162 of the present embodiment is disposed. In some embodiments, the upper 102 does not include the tongue 162, i.e., the upper 102 is tongueless.

Referring to FIG. 1, the sole structure 104 includes a midsole 164 and an outsole 166. The outsole 166 may define a bottom end or bottom surface 168 of the sole structure 104 across the heel region 112, the midfoot region 110, and the forefoot region 108. Further, the outsole 166 may be a ground-engaging portion or include a ground-engaging surface of the sole structure 104 and may be opposite of the insole thereof. As illustrated in FIG. 1, the bottom surface 168 of the outsole 166 may include a tread pattern 170 that can include a variety of shapes and configurations. The outsole 166 may be formed from one or more materials to impart durability, wear-resistance, abrasion resistance, or traction to the sole structure 104. In some embodiments, the outsole 166 may be formed from any kind of elastomer material, e.g., rubber, including thermoset elastomers or thermoplastic elastomers, or a thermoplastic material, e.g., thermoplastic polyurethane (TPU). In some embodiments, the outsole 166 may define a shore A hardness up to 95. In addition, the outsole 166 may be manufactured by a process involving injection molding, vulcanization, printing layer by layer, i.e., additive manufacturing systems or methods, and the like.

The midsole 164 may be individually constructed from a thermoplastic material, such as polyurethane (PU), for example, and/or an ethylene-vinyl acetate (EVA), copolymers thereof, or a similar type of material. In other embodiments, the midsole 164 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 164 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 164 is manufactured by a process involving injection molding, vulcanization, printing layer by layer, i.e., additive manufacturing systems or methods, and the like.

Referring to FIG. 1, in the embodiments where the midsole 164 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 164 may be formed using alternative methods known in the art, including the use of an expansion press, an injection machine, a pellet expansion process, a cold foaming process, a compression molding technique, die cutting, or any combination thereof. For example, the midsole 164 may be formed using a process that involves an initial foaming step in which supercritical gas is used to foam a material and then compression molded or die cut to a particular shape.

Figure 4:
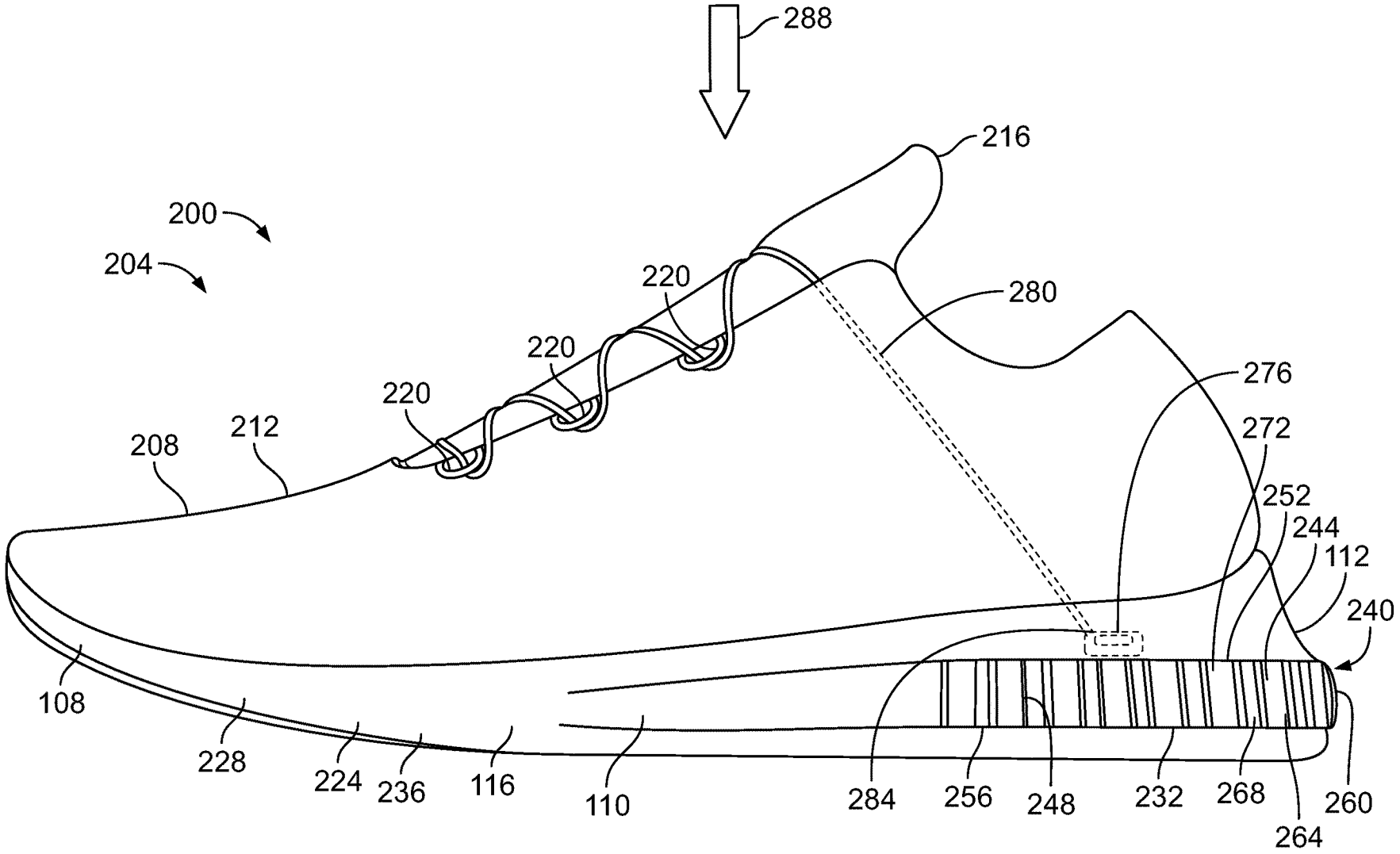
FIG. 4 is a schematic representation of a side view of a medial side of an article of footwear configured as a right shoe, according to an embodiment of the present disclosure.

Referring to FIG. 4, another embodiment of an article of footwear 200 having a fastener system 204 is configured as a right shoe 208 and includes an upper 212 with a tongue 216 and a plurality of eyelets 220 adjacent to the tongue 216. A midsole 224 has a first or midsole body 228 with a first or rear aperture 232 located on a first exterior 236 of the midsole body 228 in the heel region 112 that defines a first or main cavity 240 bounded by the rear aperture 232. A right disc 244 is configured to partially fit within the main cavity 240 and projects beyond the main cavity 240. The right disc 244 has a second or disc body 248 with a first or top surface 252 (see FIG. 8), a second or bottom surface 256 (see FIG. 12) opposite the top surface 252, and a third or circumferential surface 260 that connects the top surface 252 to the bottom surface 256 along a second exterior 264 of the right disc 244. An actuator mechanism 268 embodied as a plurality of disc teeth 272 project from the circumferential surface 260 and are rigidly connected to the disc body 248. Put another way, the plurality of disc teeth 272 of the right disc 244 are arranged circumferentially thereon. The plurality of disc teeth 272 are arranged to be exposed externally of the main cavity 240 of the sole structure 104 of footwear 200. The top surface 252 of the right disc 244 includes a cord retainer 276 which secures or retains a cord or lace 280. The cord 280 is secured to the cord retainer 276 by a first end 284, extends through the upper 212, then the plurality of eyelets 220, and then extends to and is secured to the cord retainer 276. When the cord 280 experiences tension, a downward force or compressive force 288 presses on the footwear 200, such as in the midfoot region 110 of the right shoe 208.

Figure 5:
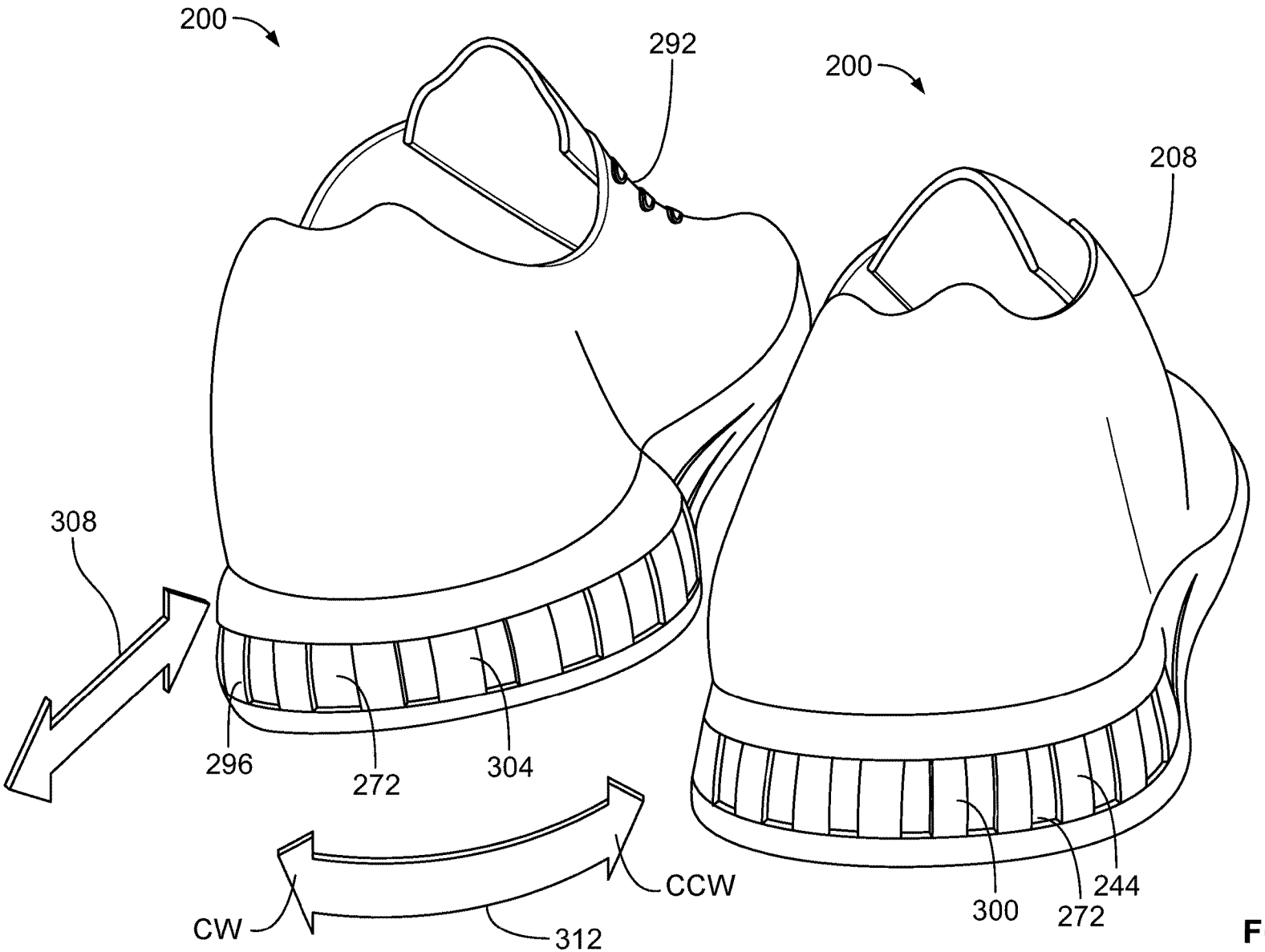
FIG. 5 is a schematic representation of a perspective view of a rear of the article of footwear of FIG. 4 configured as a right shoe and as a left shoe.

Referring to FIG. 5, the article of footwear 200 is configured as the right shoe 208 with the right disc 244, and as a left shoe 292 with a left disc 296. The left shoe 292 and the left disc 296 have identical but mirrored elements corresponding with those introduced as part of the right shoe 208 and the right disc 244, including the plurality of disc teeth 272. The plurality of disc teeth 272 of the right disc 244 are configured to mesh or engage with the plurality of disc teeth 272 of the left disc 296. For example, when the plurality of disc teeth 272 of the right disc 244 engage with the plurality of disc teeth 272 of the left disc 296, an exemplary right tooth 300 of the plurality of disc teeth 272 of the right disc 244 contacts an exemplary left tooth 304 of the plurality of disc teeth 272 of the left disc 296. When in contact, a lateral force 308 from one of the left tooth 304 or the right tooth 300 can transfer to the other of the left tooth 304 and the right tooth 300. The transfer of the lateral force 308 to the left tooth 304 tends to create a rotational force 312 in the left disc 296, and the transfer of the lateral force 308 to the right tooth 300 tends to create the rotational force 312 in the right disc 244. Therefore, when the left disc 296 engages the right disc 244, the left disc 296 and the right disc 244 can be rotated. The initiation of rotation in either the right disc 244 or the left disc 296 can be increased or reduced by contact between the two discs 244, 296. In addition, see the discussion of FIGS. 8 and 9 below for more details about how the rotation of the two discs 244, 296 can also be driven by energy stored in the cord 280.

Figure 6:
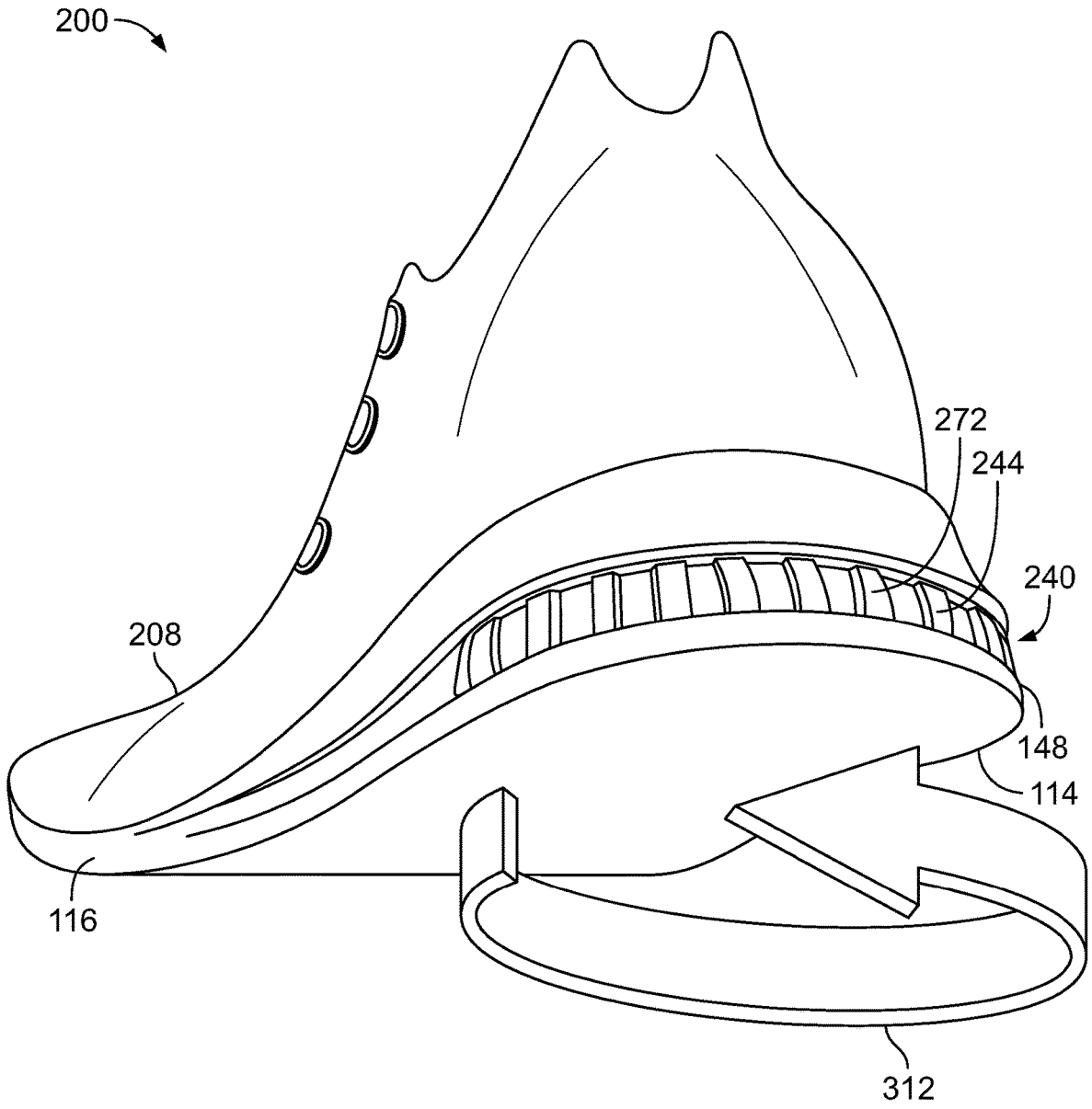
FIG. 6 is a schematic representation of a perspective view of the rear and bottom of the article of footwear of FIG. 4 configured as a right shoe with the heel region raised.

Referring to FIG. 6, the right disc 244 of the right shoe 208 is shown capable of rotation in response to the rotational force 312. In the illustrated embodiment, the plurality of disc teeth 272 extend outwardly from the main cavity 240 about the heel end 148 of the footwear 200 and, in particular, the plurality of disc teeth 272 are provided within the heel region 112 along the medial side 116 and the lateral side 114 of the footwear 200. The right disc 244 can be rotated by applying force from a variety of sources, including by manual contact, a user's hand, the opposing shoe or disc, or by pressing the plurality of disc teeth 272 against objects such as, for example, a rock, a fence, or a car tire.

Figure 7:
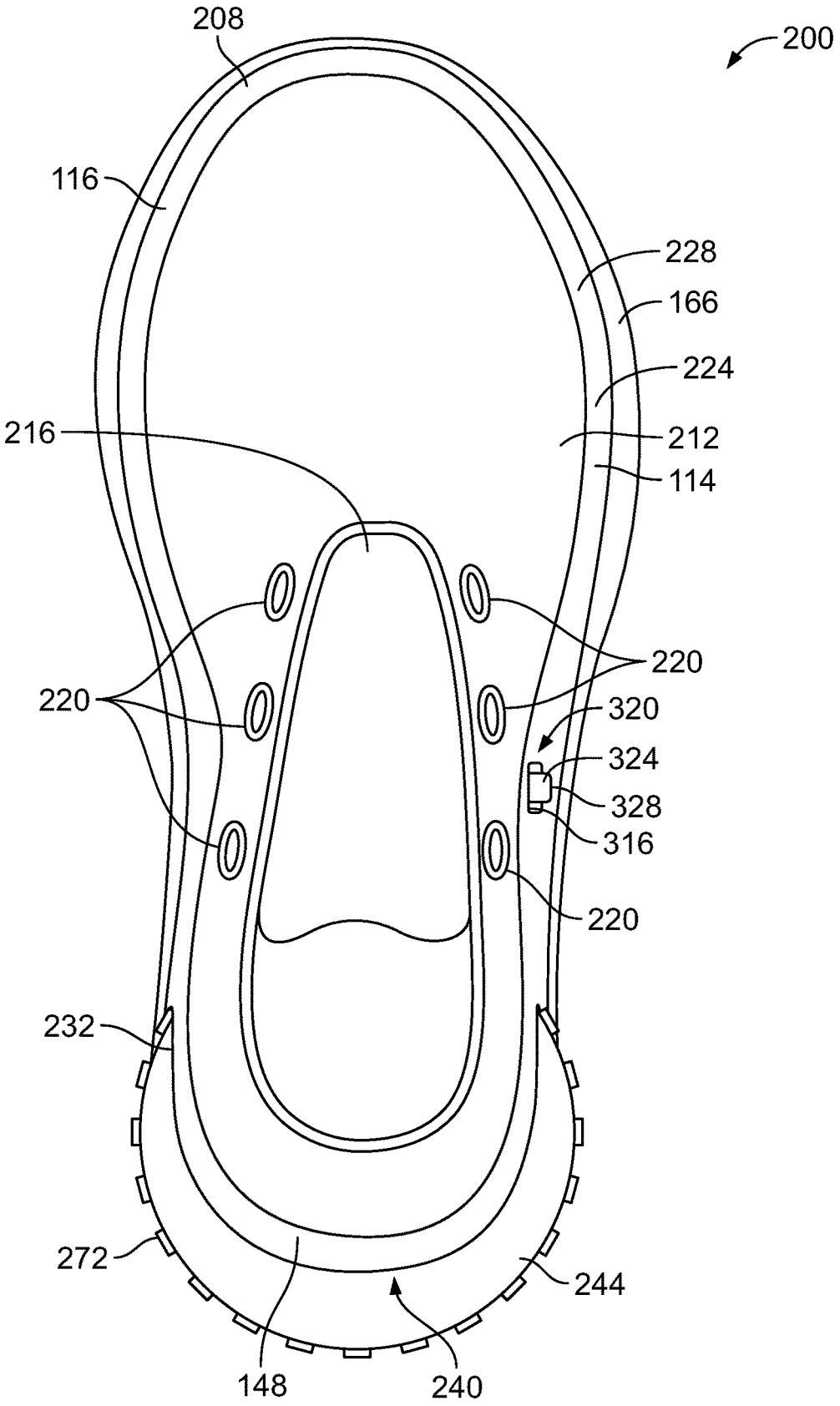
FIG. 7 is a schematic representation of a top plan view of the article of footwear of FIG. 4 configured as a right shoe with a cord hidden.

Referring to FIG. 7, the right shoe 208 is shown without the cord 280. The midsole 224 is located between the outsole 166 and the upper 212. The plurality of eyelets 220 are adjacent to the tongue 216 on the lateral side 114 and the medial side 116. The midsole body 228 defines a second or side aperture 316 which defines a first or side passage 320 on the lateral side 114 of the right shoe 208. A release mechanism 324 embodied as a release actuator 328 is shown projecting or protruding from the side passage 320 of the sole structure 104. The right disc 244 projects out beyond the main cavity 240 and at least some of the plurality of disc teeth 272 are outside the rear aperture 232 and the main cavity 240 on the medial side 116, the lateral side 114, and along the heel end 148. In some embodiments, the plurality of disc teeth 272 only project outside the rear aperture 232 on the medial side 116 or the lateral side 114. In the illustrated embodiment, the release mechanism 324 is disposed in the sole structure 104 and forwardly of the right disc 244. In some embodiments, the release mechanism 324 may be disposed rearwardly of the right disc 244 or coextensive with a forwardmost point or a rearward most point of the right disc 244. In some embodiments, the release mechanism 324 is disposed on the upper 102. In some embodiments, the release mechanism 324 is disposed on the medial side 116 or in the instep region 160. In some embodiments, the release mechanism 324 is disposed in the forefoot region 108 or the heel region 112.

Figure 8:
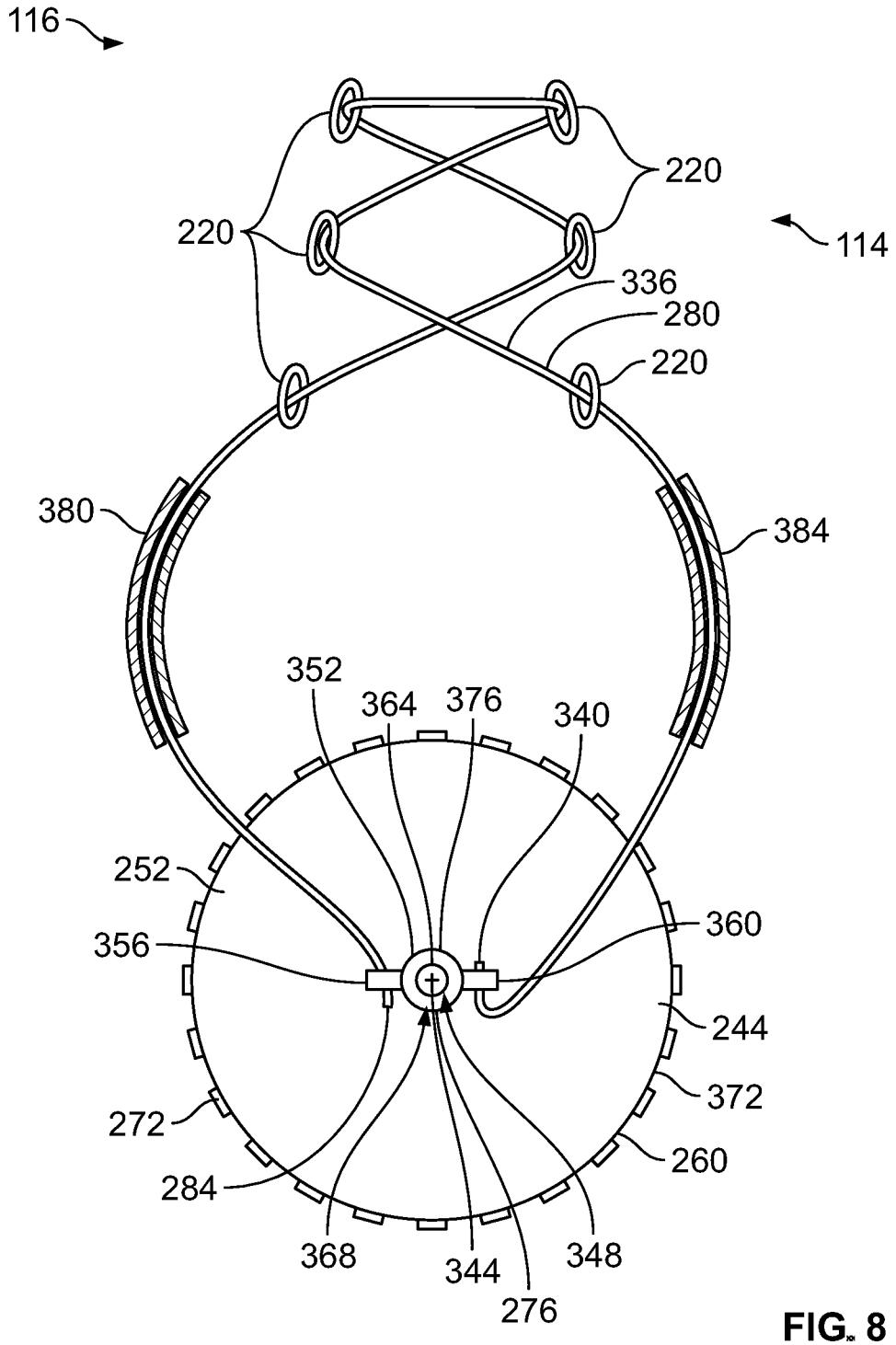
FIG. 8 is a schematic representation of a top plan view of the cord of FIG. 7 secured to a cord retainer of a disc and extending through a left sheath, a right sheath, and a plurality of eyelets.

FIG. 8 depicts an arrangement in which the cord 280 extends from the cord retainer 276 of the right disc 244 out to the plurality of eyelets 220 and then back to the cord retainer 276. The cord 280 is configured without a coil 332 (see FIG. 9). The cord 280 includes a third or cord body 336 having the first end 284 and a second end 340 at the opposite ends of the cord body 336. The cord 280 is flexible and capable of transmitting tension or tensile forces. In some embodiments, the cord is made of fabric, fabric coated with plastic, or flexible plastic braids. The cord retainer 276 of the right disc 244 has a first center 344 that intersects a first axis 348 that projects perpendicularly from the top surface 252. The right disc 244 rotates in the heel region 112 about the first axis 348. In some embodiments, first axis 348 is disposed orthogonal to the central axis 118 (see FIG. 1). In some embodiments, the first axis 348 intersects the central axis 118 (see FIG. 3) of the right shoe 208. In some embodiments, the first axis 348 does not intersect the central axis 118 (see FIG. 3) of the right shoe 208. The cord retainer 276 includes a first or disc post 352 that connects to a first retainer 356 configured to secure the first end 284 of the cord 280, and to a second retainer 360 configured to secure the second end 340 of the cord 280. The disc post 352 further includes a third or upper aperture 364 that intersects the first axis 348 and defines a second or upper cavity 368. The first end 284 and the second end 340 can be retained or secured by welding, overmolding, interference fit, by forming knots at the first end 284 and the second end 340 to retain on the first retainer 356 or the second retainer 360, by adhesive, or by winding the first end 284 and the second end 340 around the disc post 352 to secure the cord 280 to the cord retainer 276. A first or top edge 372 of the top surface 252 contacts the circumferential surface 260 and has a circular shape that is centered about the first axis 348. The plurality of disc teeth 272 project radially outwardly from the top edge 372 away from the first axis 348.

In some embodiments, the first end 284 is secured to the first retainer 356 of the cord retainer 276. In some embodiments, the cord 280 is wound around a circumference 376 of the cord retainer 276 prior to the cord 280 being passed through a left sleeve or sheath 380 (see FIG. 9). The cord 280 extends through one of the plurality of eyelets 220 on the medial side 116 (see FIG. 7), and then to one of the plurality of eyelets 220 on the lateral side 114 (see FIG. 7), and back and forth until the cord 280 connects the plurality of eyelets 220 on the medial side 116 to the plurality of eyelets 220 on the lateral side 114. The cord 280 extends into a right sleeve or sheath 384. The cord 280 extends to the cord retainer 276.

Figure 9:
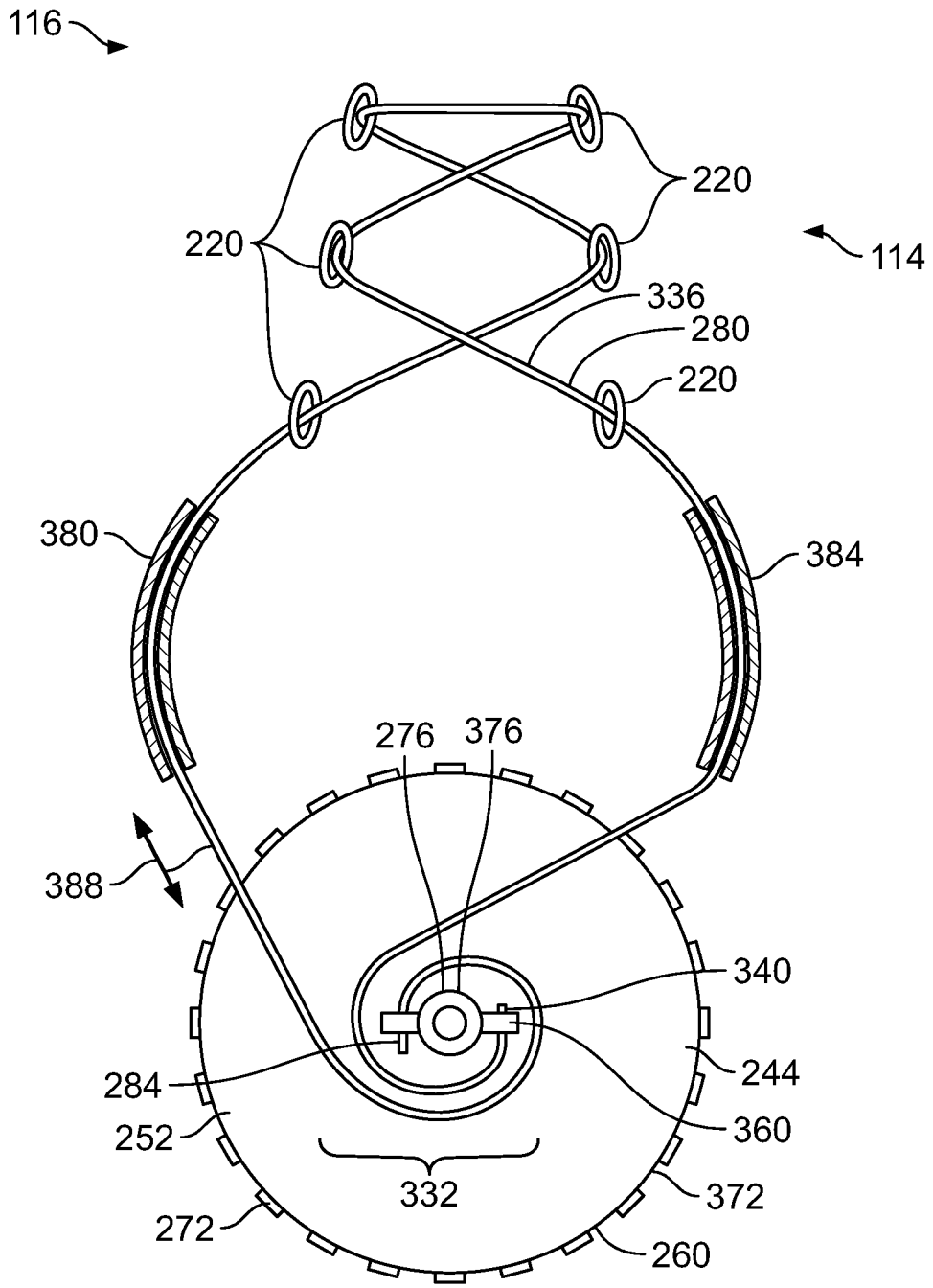
FIG. 9 is a schematic representation of a top plan view of FIG. 8 with the cord coiled around the cord retainer.

Referring to FIG. 9, in some embodiments, the cord 280 is wound around the circumference 376 of the cord retainer 276 prior to securing the second end 340 to the cord retainer 276, thereby forming the coil 332. The second end 340 of the cord 280 is secured to the second retainer 360. Once so arranged, when the right disc 244 experiences the rotational force 312 (see FIG. 6) to cause rotation, the cord 280 wraps or unwraps around the circumference 376 of cord retainer 276. Further, tension in the cord 280 is stored as a potential energy 388. As the cord 280 wraps around the cord retainer 276, the cord 280 forms the coil 332 around the circumference 376 of the cord retainer 276, and the amount of the potential energy 388 stored in the tension of the cord 280 as the tension in the cord 280 increases. The tension in the cord 280 produces the downward force 288 in the midfoot region 110 (see FIG. 4). As the size of the coil 332 increases, the amount of potential energy 388 stored as tension in the cord 280 increases. As the amount of potential energy 388 stored as tension in the cord 280 increases, the magnitude of the downward force 288 increases.

Referring to FIGS. 8 and 9, in some embodiments, the left sheath 380 and the right sheath 384 (see FIG. 8) are made of a relatively rigid and dense material compared to the material of the cord 276. In some embodiments, the left sheath 380 and the right sheath 384 can be made of a flexible or rigid plastic material. In some embodiments, the two sheaths 380, 384 assist in guiding the cord 280 to the cord retainer 276. In some embodiments, the left sheath 380 and the right sheath 384 direct the cord 280 through the upper 212, outside of the upper 212, or on the inside of the upper 212 and also through the midsole 224 to reach the rear aperture 232 (see also FIG. 4).

Figure 10:
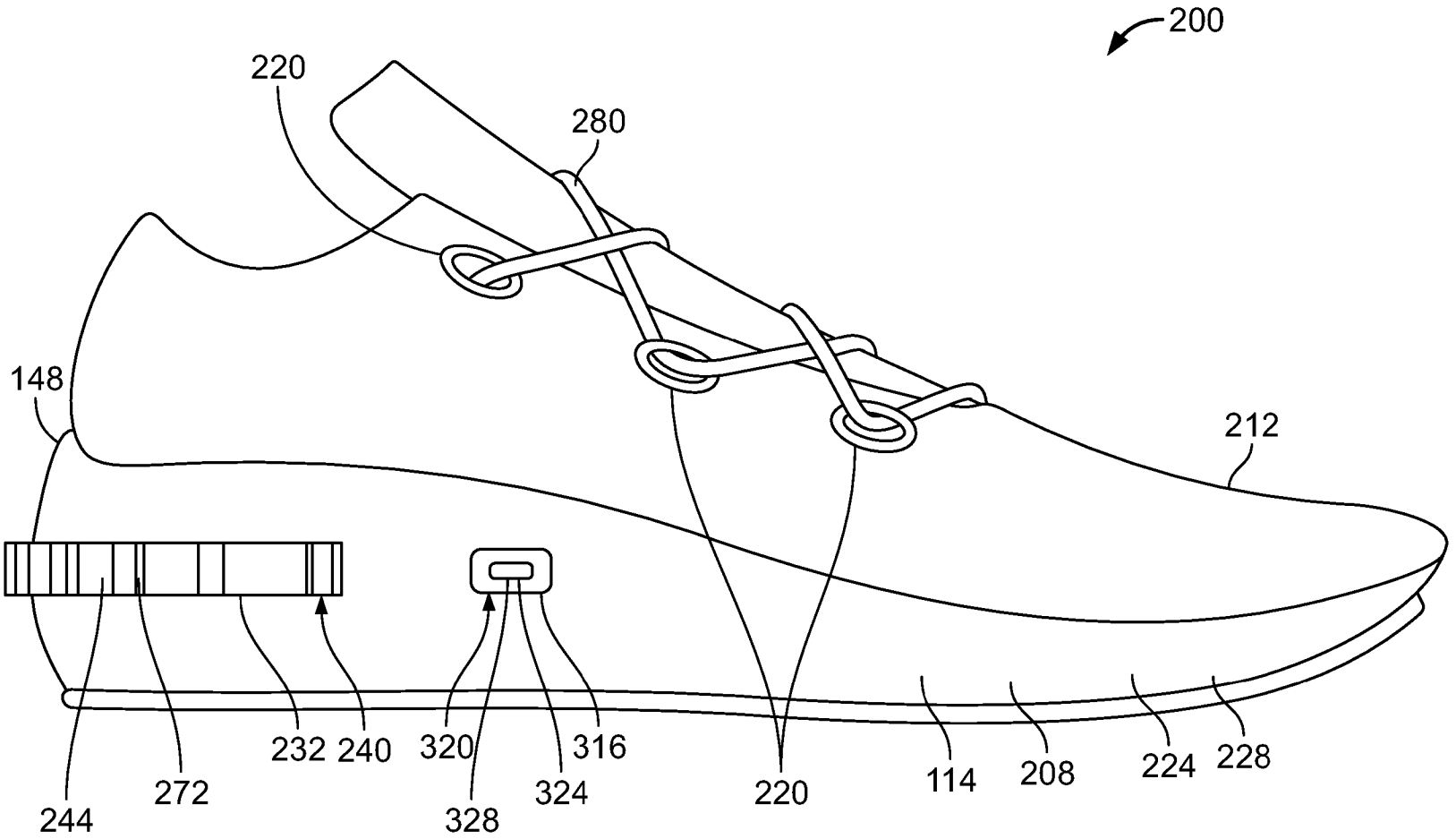
FIG. 10 is a schematic representation of a side view of the lateral side of the article of footwear of FIG. 4 configured as a right shoe.

Referring to FIG. 10, the lateral side 114 of the right shoe 208 shows the cord 280 extending through the plurality of eyelets 220 on the lateral side 114 of the upper 212. The plurality of disc teeth 272 of the right disc 244 extend outwardly from the rear aperture 232 and the main cavity 240 on the lateral side 114 and the heel end 148. The midsole body 228 defines the side aperture 316 which defines the side passage 320. The release actuator 328 projects through the side passage 320.

Figure 11:
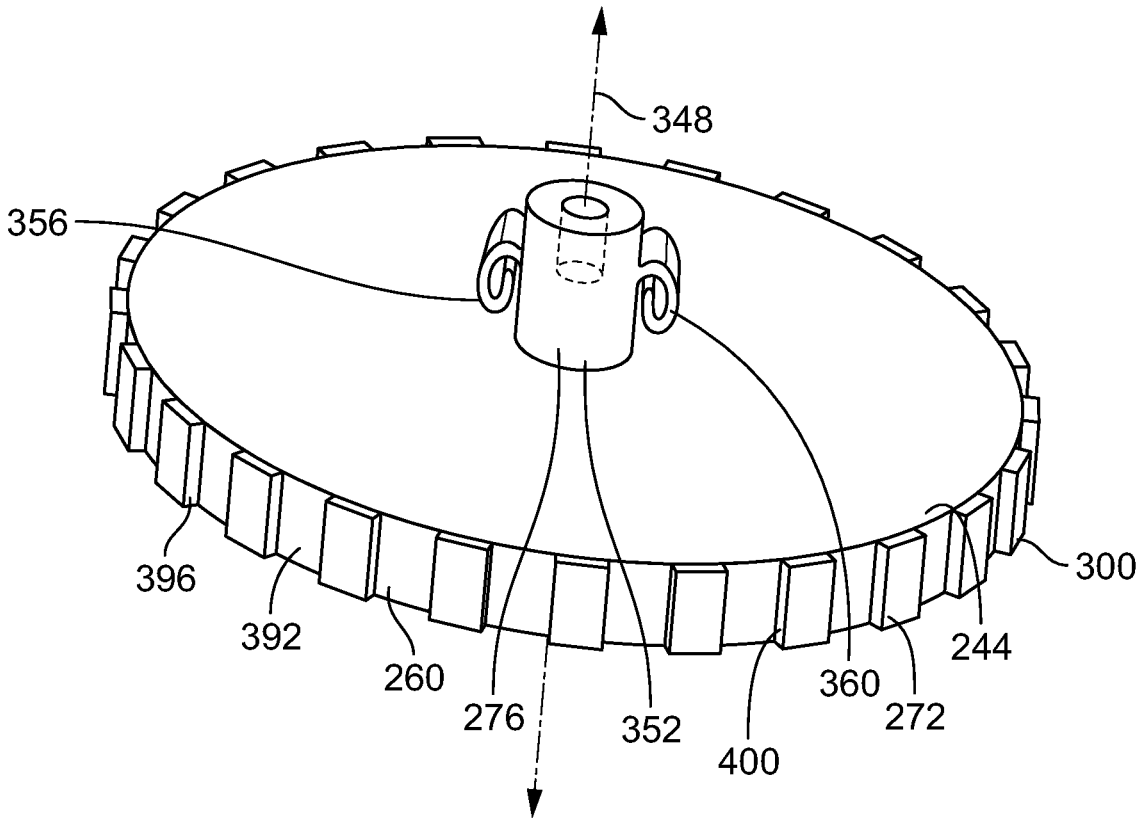
FIG. 11 is a schematic representation of a perspective view of a top of a disc suitable for use with the article of footwear of FIG. 4.

Referring to FIG. 11, the disc post 352 of the cord retainer 276 of the right disc 244 intersects the first axis 348 and is connected to the first retainer 356 and the second retainer 360. In some embodiments, the right disc 244 is made of a rigid plastic or metallic material. In some embodiments, the first retainer 356 is offset 180 degrees about the first axis 348 from the second retainer 360. In some embodiments, the first retainer 356 and the second retainer 360 are configured as open loops or closed loops to facilitate retaining or securing the first end 284 and the second end 340 of the cord 280 (see FIGS. 8 and 9). The circumferential surface 260 includes a fourth or radial surface 392, a fifth or left surface 396, and a sixth or right surface 400. The radial surface 392 faces radially outwardly from the first axis 348 and is located between each of the plurality of disc teeth 272 along the circumferential surface 260. Each of the plurality of disc teeth 272 has the left surface 396 that faces one of the adjacent teeth of the plurality of disc teeth 272 and the right surface 400 faces away from the left surface 396. That is, the left surface 396 faces the plurality of disc teeth 272 to one side, and the right surface 400 faces the plurality of disc teeth 272 to the other side. The engagement or meshing of the right tooth 244 and the left tooth 304 (see FIG. 5) occurs at either the left surface 396 or the right surface 400.

Figure 12:
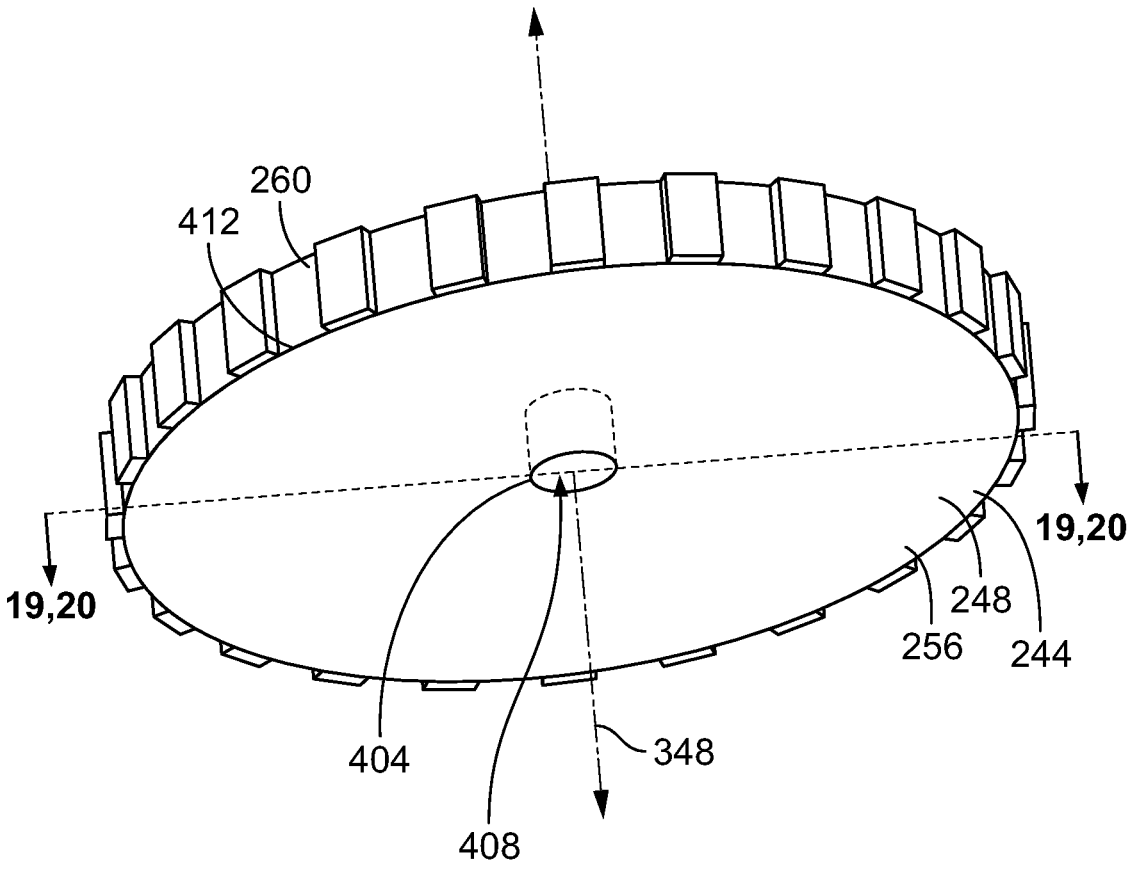
FIG. 12 is a schematic representation of a perspective view of a bottom of the disc of FIG. 11.

Referring to FIG. 12, the right disc 244 includes the disc body 248 which has the bottom surface 256. The bottom surface 256 defines a fourth or lower aperture 404 which intersects the first axis 348 and defines a third or lower cavity 408. The bottom surface 256 contacts the circumferential surface 260 along a second or lower edge 412, and is spaced from the lower aperture 404. The lower edge 412 is circularly shaped. In some embodiments, the lower aperture 404 is cylindrical in shape, and is a "blind hole." That is, the lower aperture 404 does not extend through the right disc 244 and reach the top surface 252.

Figure 13:
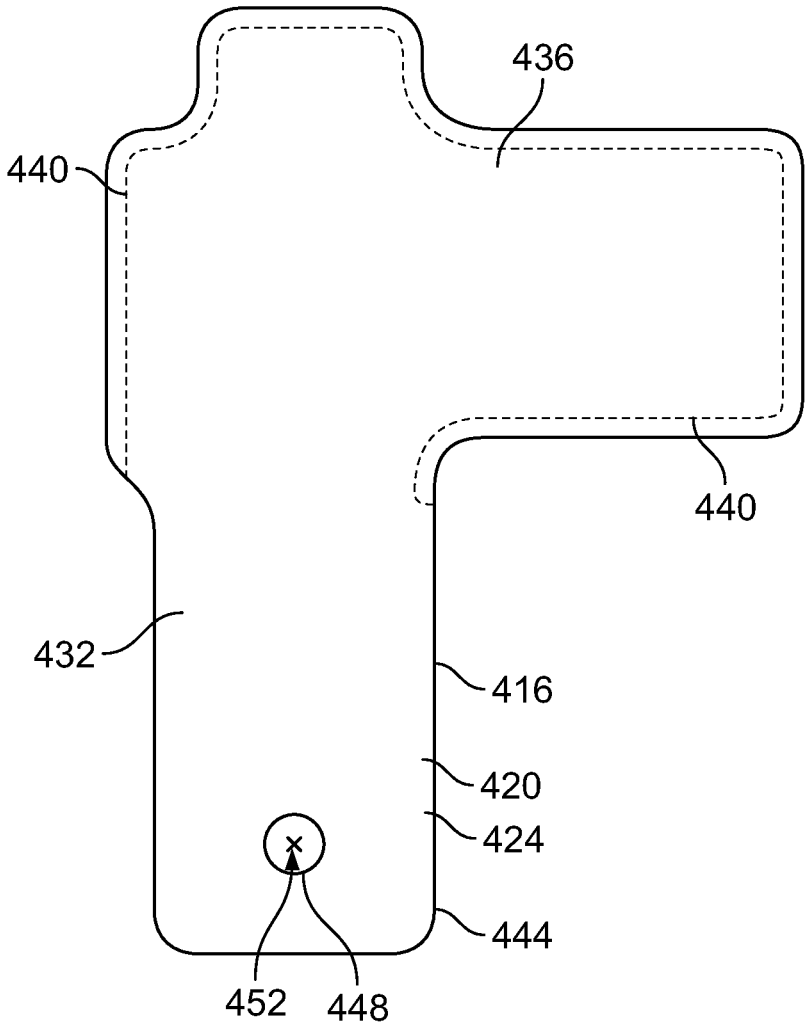
FIG. 13 is schematic representation of a top view of a cover suitable for use with the article of footwear of FIG. 4 with portions shown in phantom lines.
Figure 14:
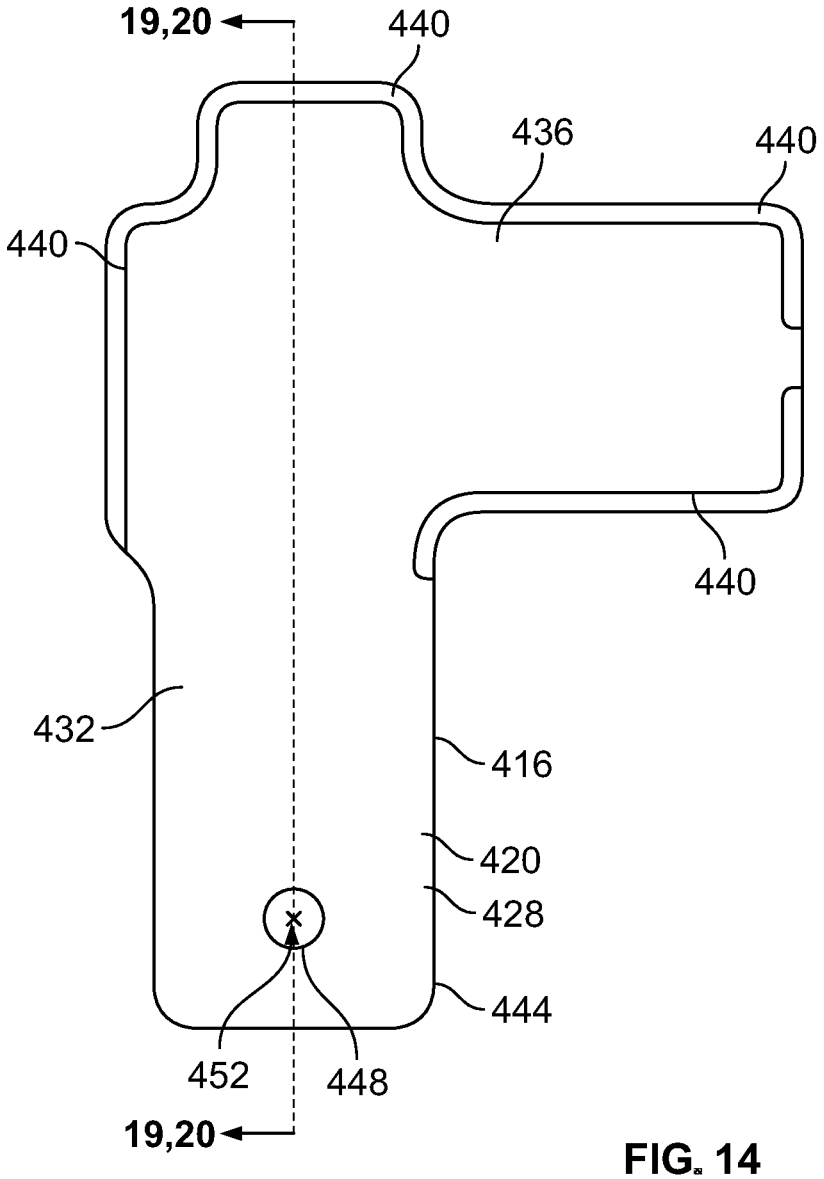
FIG. 14 is schematic representation of a bottom view of the cover of FIG. 13.

Referring to FIGS. 13 and 14, a cover 416 is configured to partially retain the right disc 244 (see FIGS. 11 and 12). The cover 416 has a fourth or cover body 420 with a seventh or upper surface 424 (FIG. 13) and an eighth or lower surface 428 (FIG. 14). The cover body 420 has a first or narrow section 432 and a second or wide section 436. The wide section 436 is wider than the narrow section 432, and includes a plurality of skirts 440 that project from the lower surface 428 along some of a third or cover edge 444 that defines the perimeter of the lower surface 428. The narrow section 432 includes a second or cover post 448. In some embodiments, the cover post 448 is cylindrical in shape, projects farther from the upper surface 424 than the plurality of skirts 440, and is centered about a second axis 452.

Figure 15:
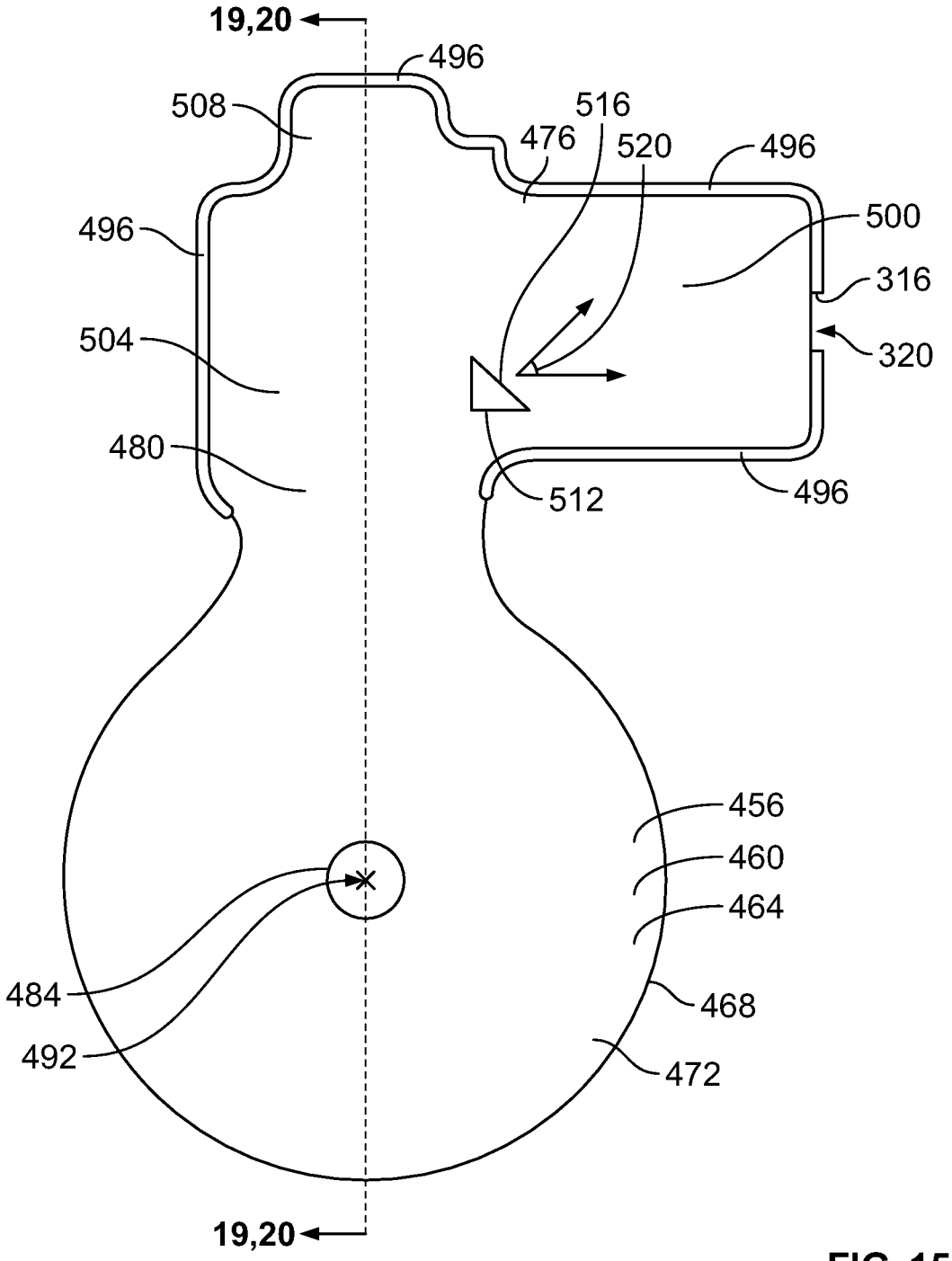
FIG. 15 is a schematic representation of a top view of a housing suitable for use with the article of footwear of FIG. 4.
Figure 16:
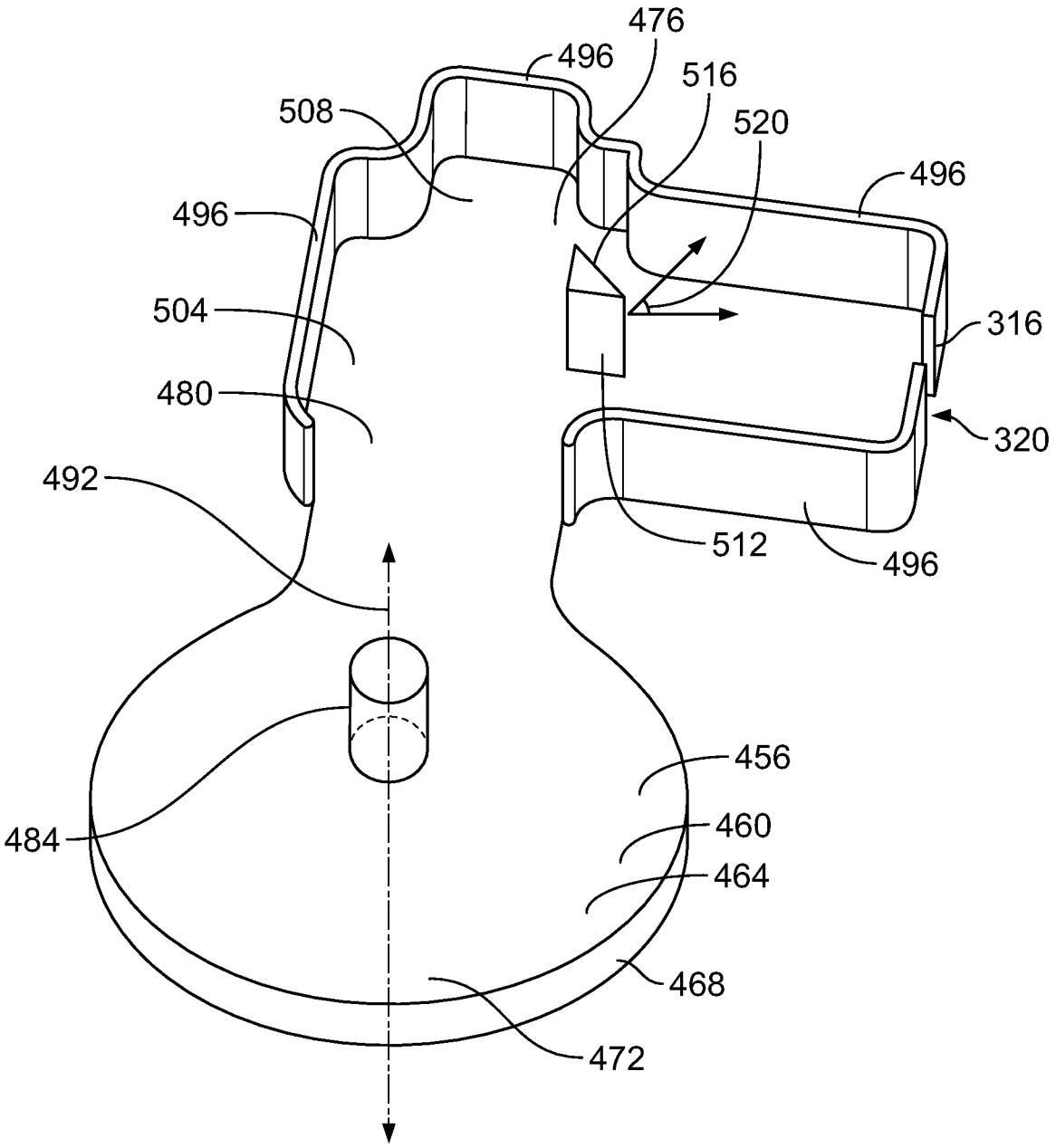
FIG. 16 is a schematic representation of a perspective view of the housing of FIG. 15.

Referring to FIGS. 15 and 16, a housing 456 has a fifth or housing body 460 with a ninth or housing surface 464 bounded by the perimeter defined by a fourth or housing edge 468. The housing surface 464 defines a third or lower section 472 and a fourth or upper section 476 which are separated by a fifth or engagement section 480. The lower section 472 has a third or housing post 484 that projects from the housing surface 464. In some embodiments, the housing post 484 is cylindrically shaped and a third axis 492 extends centrally therethrough. The upper section 476 includes a plurality of sidewalls 496 along a portion of the housing edge 468 that project from the housing surface 464. The upper section 476 includes a first or lateral region 500, a second or medial region 504, and a third or upper region 508. The lateral region 500 includes the side aperture 316, which defines the side passage 320, at least one of the plurality of sidewalls 496, and a deflector 512 located between the lateral region 500 and the medial region 504. The deflector 512 projects from the housing surface 464 and has a tenth or deflector surface 516 facing with respect to the side aperture 316 at a first acute angle 520. The medial region 504 includes at least one of the plurality of sidewalls 496, and contacts the engagement section 480, the upper region 508, and the deflector 512. The upper region 508 includes at least one of the plurality of sidewalls 496 and contacts the medial region 504.

Figure 17:
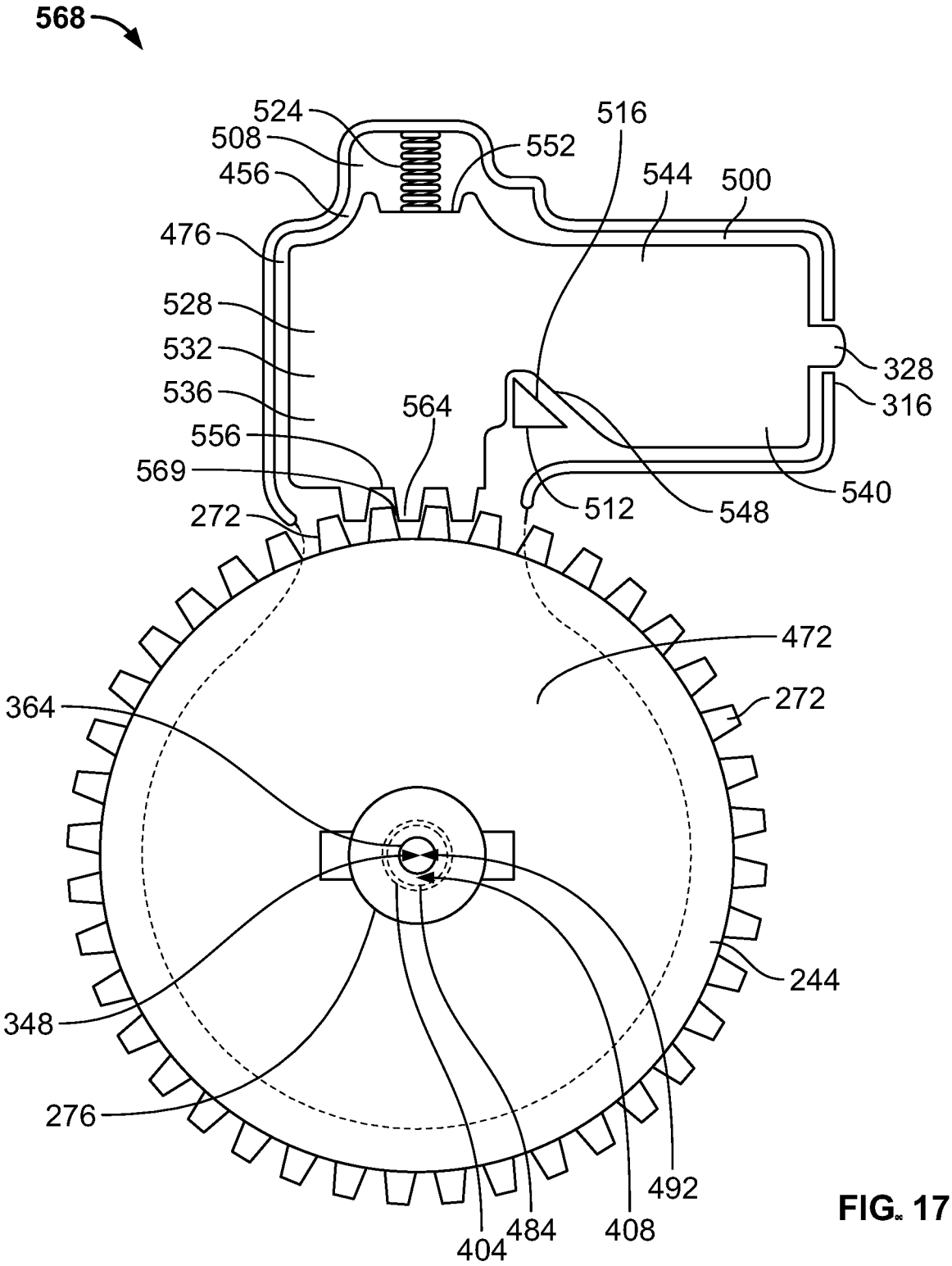
FIG. 17 is a schematic representation of a top view of a closure mechanism in a locked configuration including the housing of FIG. 15 with portions shown in phantom lines.

Referring to FIG. 17, the housing 456 is shown with a spring 524 positioned in the upper region 508 of the upper section 476, the right disc 244 retained to the lower section 472, and a tension lock 528 with the release actuator 328. The tension lock 528 has a sixth or lock body 532, which defines an engagement body 536, a deflection body 540, and a narrow body 544 which connects the engagement body 536 to the deflection body 540. The deflection body 540 is configured to be positioned in the lateral region 500 and has the release actuator 328 projecting toward or through the side aperture 316. The deflection body 540 defines an eleventh or deflecting surface 548. The deflector surface 516 of the deflector 512 is configured to face the deflecting surface 548 of the deflection body 540. The engagement body 536 has a twelfth or spring seat surface 552 that faces the spring 524 and away from the lower section 472 so that the spring 524 can press upon or compress the engagement body 536. The engagement body 536 has a thirteenth or engagement surface 556 with a closure mechanism embodied as a plurality of engagement teeth 564 that faces toward the lower section 472.

The right disc 244 is in a locked configuration 568 when the plurality of engagement teeth 564 engage or mesh with the plurality of disc teeth 272 of the right disc 244. The spring 524 biases the tension lock 528 into contact with the right disc 244. The right disc 244 is retained in the lower section 472 of the housing 456 by the housing post 484 of the housing 456 being inserted or retained within the lower cavity 408 of the lower aperture 404 of the right disc 244. In the locked configuration 568, the third axis 492 of the housing post 484 of the housing 456 is aligned with the first axis 348 of the right disc 244. In the locked configuration 568 the release actuator 328 of the tension lock 528 projects beyond the housing 456 and the side aperture 316. The plurality of engagement teeth 564 are configured so that the plurality of disc teeth 272 can overcome the bias of engagement with the plurality of engagement teeth 564 by overcoming the compression of the spring 524 and allowing each of the plurality of disc teeth 272 to rotate with respect to each of the plurality of engagement teeth 564. To that end, the plurality of engagement teeth 564 and/or the plurality of disc teeth 272 may include sloped or ramped surfaces forming a camming interface 569 for providing a mechanical advantage to assist in overcoming the biasing force of the spring 524. The camming interface 569 may be disposed on only one side of the teeth 564, 272 to correspond with rotation in a direction that results in further winding of the cord 280 about the cord retainer 276 in the locked configuration 568, thereby permitting tightening adjustments to be made by rotation in that winding direction. On the opposing side of the teeth 564, 272, no such camming surface 569 may be formed, thereby resisting or preventing unwinding or loosening adjustments resulting from rotation of the right disc 244 in the opposite direction while in the locked configuration 568.

In some embodiments, the locked configuration 568 may be configured to require a significant amount of force to overcome the spring 524, so that once the tension on the cord 280 is set, the magnitude of the downward force 288 on the midfoot region 110 (see FIG. 4) can be set, and then maintained. In this way, in the locked configuration 568, the adjustment of the compression on the midfoot region 110 applied by the downward or compressive force 288 can be selectively adjusted, set, and maintained by operation of the tension lock 528. Additionally, an audible feedback, e.g., clicking sound, is produced by the biased engagement between the plurality of engagement teeth 564 and the plurality of disc teeth 272 during rotation in the winding direction. The audible feedback is a function of the spring 524 that biases or presses the plurality of engagement teeth 564 against the plurality of disc teeth 272. The audible feedback can indicate to the user that right disc 244 is rotating in the winding direction and, thus, the footwear 200 is increasing in tightness.

Figure 18:
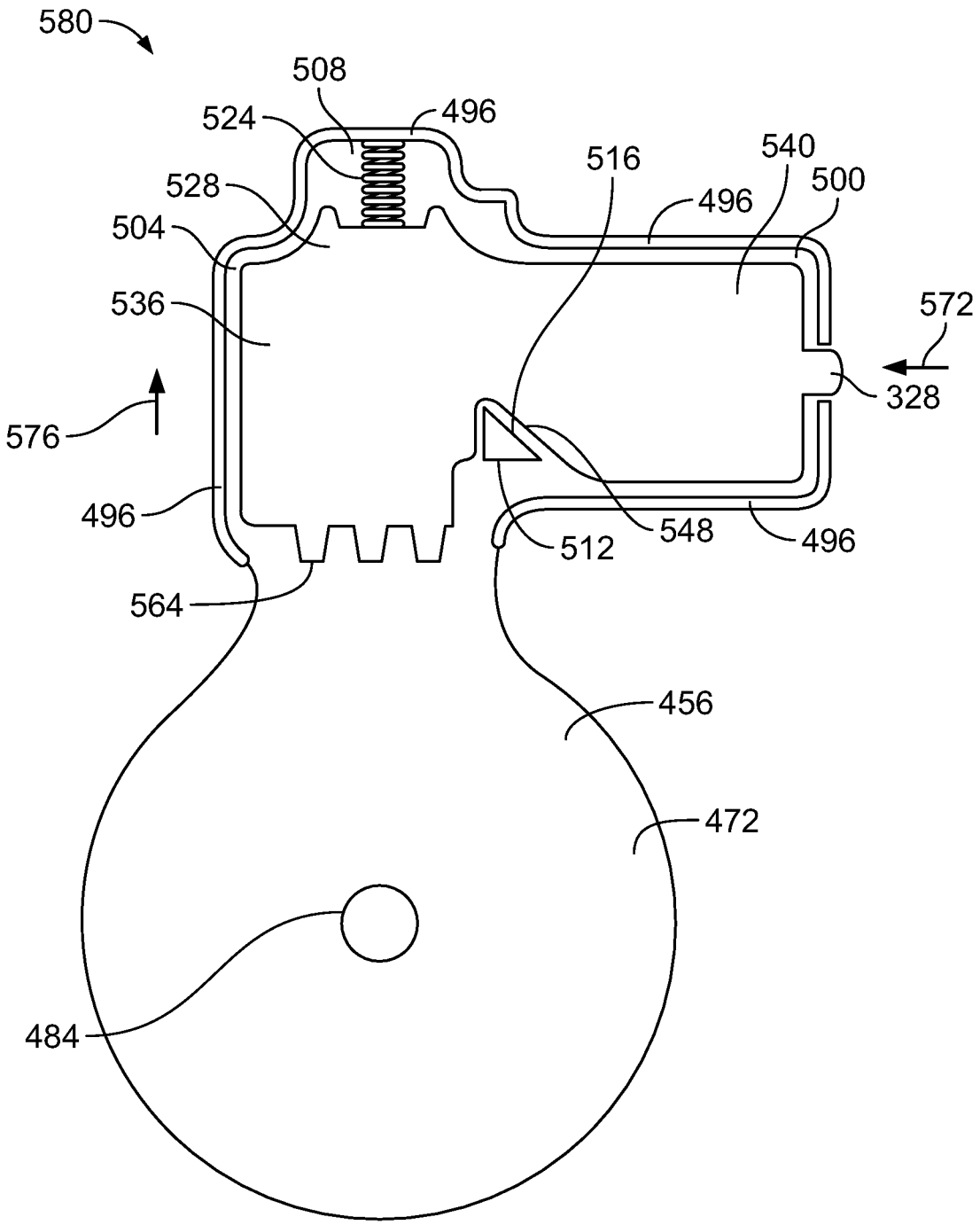
FIG. 18 is a schematic representation of a top view of the closure mechanism of FIG. 17 in an unlocked configuration including the housing of FIG. 15.

Referring to FIG. 18, the plurality of engagement teeth 564 of the tension lock 528 can be moved out of engagement with the plurality of disc teeth 272 (see FIG. 17) by exertion of a first or actuating force 572 that is directed at the release actuator 328 in a direction toward the medial region 504. Accordingly, the release actuator 328 is pushed toward the medial region 504 by the actuating force 572. In some embodiments, the release actuator 328 may be pressed fully into the lateral region 500, and in some embodiments, the release actuator 328 may be pressed partially into the lateral region 500 by the actuating force 572. The actuating force 572 transfers the force to the deflection body 540 so that the deflecting surface 548 contacts and then slides along the deflector surface 516 of the deflector 512, which moves the engagement body 536 with a second or unlocking force 576 toward the spring 524 and away from the lower section 472. The engagement body 536 is configured to fit within the plurality of sidewalls 496 so that the engagement body 536 can move away from the lateral region 500 and toward the upper region 508 when subjected to the actuating force 572 and the unlocking force 576. The right disc 244 is in an unlocked configuration 580 when the engagement body 536 overcomes the biasing force of the spring 524, and the plurality of engagement teeth 564 become disengaged from the plurality of disc teeth 272 of the right disc 244 (see FIG. 17).

In the unlocked configuration 580, the adjustment of the tension of the cord 280 does not require a significant amount of force, so that the tension on the cord 280 (see FIG. 10) can be adjusted, thereby changing the magnitude of the downward force 288 on the midfoot region 110 (see FIG. 4) prior to engaging the plurality of engagement teeth 564 and allowing the downward force 288 to be set or adjusted as desired. In this way, in the unlocked configuration 580, the adjustment of the compression on the midfoot region 110 applied by the downward force 288 can be selectively adjusted, by disengagement with the plurality of engagement teeth 564 of the tension lock 528. If the cord 280 is wrapped around the cord retainer 276 to form the coil 332 when the plurality of engagement teeth 564 is in the unlocked configuration 580, the potential energy 388 stored in the cord 280 is released to assist in unwinding of the cord 280 around the circumference 376 of the cord retainer 276, and therefore the right disc 244. In this way, the release of the compression on the midfoot region 110 is expedited.

Figure 19:
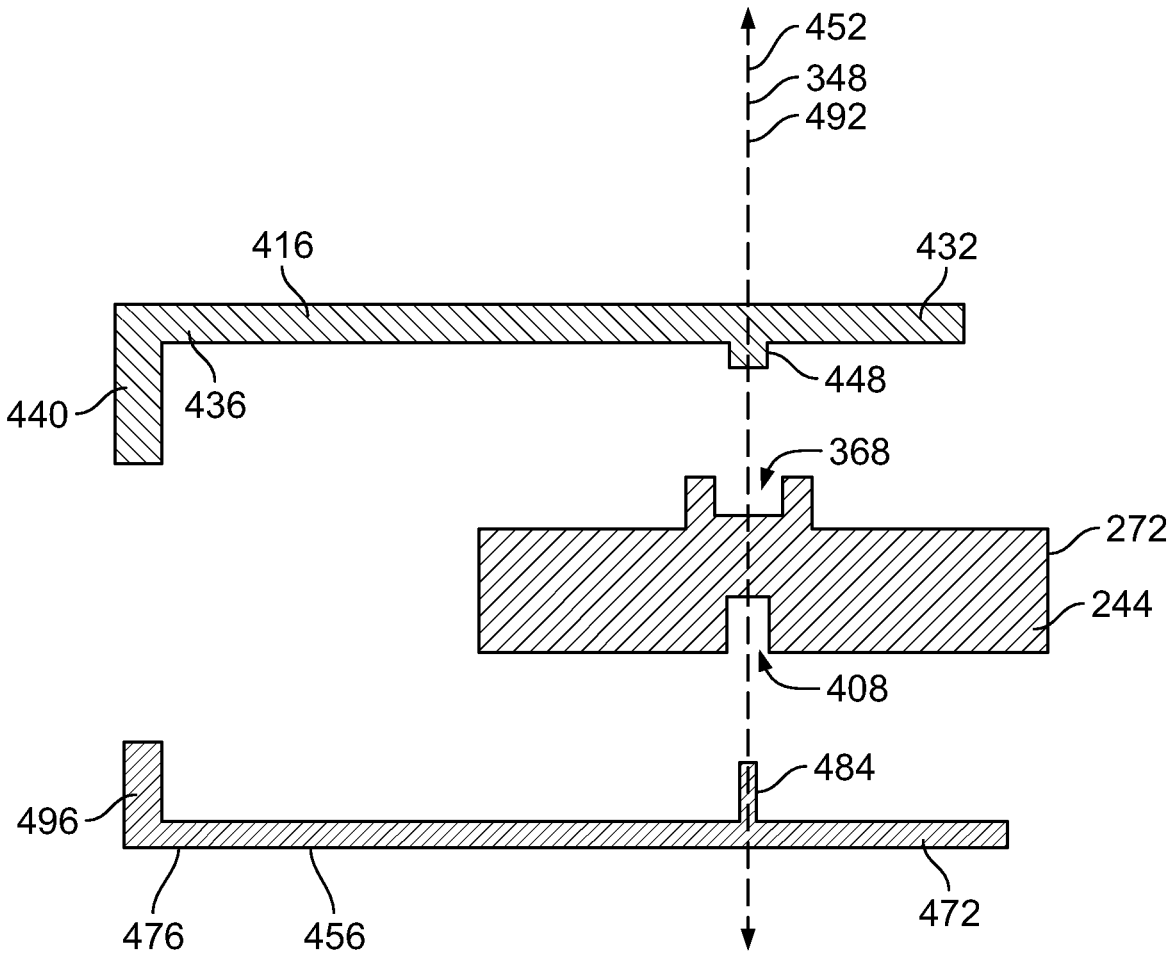
FIG. 19 is a schematic representation of a sectional view of the disc of FIG. 12 taken along the line 19-19 of FIG. 12 depicted in an exploded view with the cover of FIG. 14 and the housing of FIG. 15.
Figure 20:
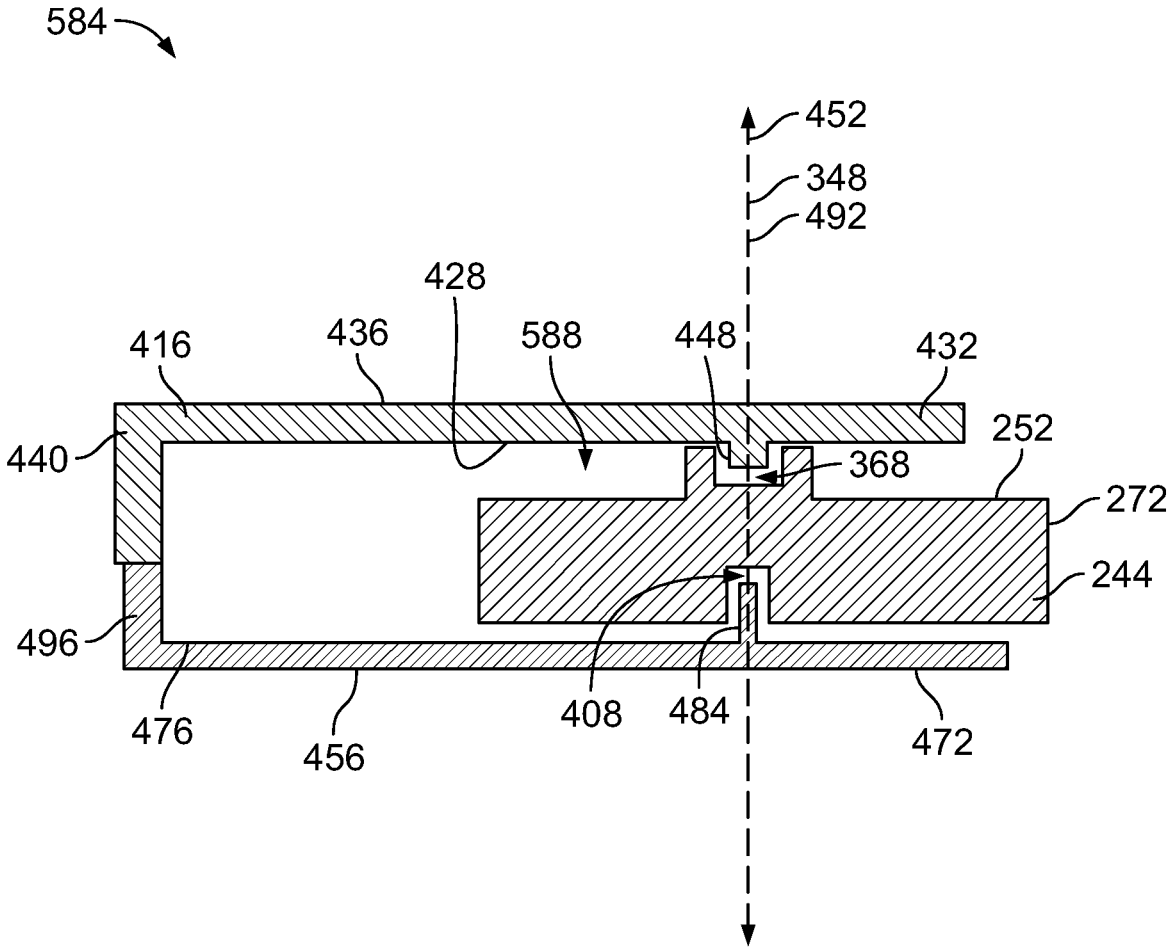
FIG. 20 is a schematic representation of a sectional view of the disc of FIG. 12 taken along the line 20-20 of FIG. 12 depicted in an assembled configuration with the cover of FIG. 14 and the housing of FIG. 15.

Referring to FIGS. 19 and 20, the cross sections of the cover 416, the right disc 244, and the housing 456 are illustrated with the first axis 348 of the right disc 244 aligned with the second axis 452 of the cover 416 and the third axis 492 of the housing 456. The cover 416, the right disc 244, and the housing 456 are configured to be assembled together and to be inserted into the main cavity 240 formed by the rear aperture 232 of the midsole 164 (see FIG. 4). The cover post 448 of the cover 416 is configured to fit within the upper cavity 368 of the right disc 244, and the housing post 484 of the housing 456 is configured to fit within the lower cavity 408 of the right disc 244. The plurality of skirts 440 of the cover 416 are configured to retain the plurality of sidewalls 496 of the housing 456. The right disc 244 is free to rotate about the first axis 348 while confined, retained, and secured between the cover 416 and the housing 456, with at least some of the plurality of disc teeth 272 projecting outwardly from the main cavity 240 of the midsole 224 (see FIG. 4). The narrow section 432 of the cover 416 is aligned with the lower section 472 of the housing 456 when the second axis 452 and the third axis 492 are aligned. The wide section 436 of the cover 416 is aligned with the upper section 476 of the housing 456 when the plurality of skirts 440 is secured to the plurality of sidewalls 496.

Referring to FIG. 20, when the cover 416, the housing 456, and the right disc 244 are assembled together, the assembly is a disc heel fastener 584. When assembled as the disc heel fastener 584, a volume of space between the lower surface 428 and the top surface 252 defines a fourth or cord cavity 588. When the right disc 244 is rotated by the rotational force 312 (see FIG. 6) in, e.g., a first direction or clockwise direction CW when viewed from above the footwear 200 looking down, the cord 280 extends around the circumference 376 of the cord retainer 276 (see FIGS. 8 and 9) within the cord cavity 588 to increase the size of the coil 332 of the cord 280 around the circumference 376 of the cord retainer 276. Further, when the release mechanism 324 is actuated and the right disc 244 is in the unlocked configuration, the rotational force 312 can be applied in the second direction or counterclockwise direction CCW as viewed from above the footwear 200 looking down, to decrease the size of the coil 332 of the cord 280 around the circumference 376 of the cord retainer 276. Accordingly, the disc heel fastener 584 provides a way to tighten and loosen the midfoot region 110 of the article of footwear 200 without having to tie any shoelaces.

Further, due to the spacing and arrangement of the plurality of teeth 272 about the circumference of the right disc 244, further rotation in the first direction CW allows for incremental adjustments in tightening the article of footwear 200 according to user preferences and comfort. In some embodiments, a magnitude of the incremental adjustments is a function of a magnitude of a radial spacing and size of the plurality of teeth 272 of the right disc 244 and/or left disc 296, as well as a lateral spacing and size of the plurality of engagement teeth 564 (see FIG. 17). For example, smaller or finer incremental adjustments can be afforded by reducing the magnitude of the radial spacing of the plurality of teeth 272 and the lateral spacing of the plurality of engagement teeth 564. It will be appreciated that the footwear 200 is considered to be tightened or adjusted to a tightened configuration when the compressive force 288 is exerted on the user's foot. As described herein, the footwear 200 may be incrementally adjusted to increase the compressive force 288 within the tightened configuration. Further, the footwear 200 is considered to be in the loosened configuration when the compressive force 288 is not exerted or not sensed on the user's foot, or when the footwear 200 is in the unlocked configuration and the compressive force 288 is easily overcome, thereby allowing the user to remove the footwear 200 from the foot.

It will be appreciated that the left disc 296 operates similarly but in a mirrored fashion to the right disc 244. In some embodiments, the left disc 296 is rotated in the second direction CCW to tighten the footwear 200 and, when in the unlocked configuration, rotated in the first direction CW to loosen the footwear 200. However, it is within the scope of the present disclosure that the first direction CW and second direction CCW may be reversed to effect tightening or loosening for the right disc 244 and left disc 296. In some embodiments, the right disc 244 and the left disc 296 of the footwear 200 are not mirrored and, instead, are both configured to be tightened by rotation in the first direction CW or the second direction CCW.

According to some embodiments of the present disclosure, the user can place one of the right disc 244 or the left disc 296 in the unlocked configuration and then exert the rotational force 312 on the other of the right disc 244 or the left disc 296 for adjusting tightness. For instance, the right disc 244 can be unlocked by actuation of the release mechanism 324 and then tightened by engaging the plurality of teeth 272 of the left disc 296 with the plurality of teeth 272 of the right disc 244 as the left disc 296 is moved, e.g., scraped or slid, in the forward direction, i.e., moving from the heel end 148 toward the toe end 142. Because the left disc 296 is in the locked configuration, rotation in the first direction CW is prevented, allowing the user to tighten one foot at a time without having to bend down and tie laces or rotate the discs 244, 296 by hand.

In another example, the operative directions of the right and left discs 244, 296 are reversed to provide for rearward movement of one disc against the other for tightening. For instance, the right disc 244 is configured to be rotated in the second direction CCW to tighten the footwear 200 and the first direction CW, when in the unlocked configuration, to loosen the footwear 200. Accordingly, the left disc 296 is configured to be rotated in the first direction CW to tighten the footwear 200 and the second direction CCW, when in the unlocked configuration, to loosen the footwear 200. This way, a user can plant one foot on the ground and shift weight to that foot while the other foot is suspended or lightly contacting the ground, position one disc forwardly of the other, and then slide the forwardly-positioned disc in a rearward direction, i.e., moving from the toe end 142 toward the heel end 148 to tighten the planted foot using the suspended foot. In some embodiments, the left disc 296 is planted on the ground and the right disc 244 is positioned forwardly thereof, e.g., adjacent the midfoot region 110 or the forefoot region 108 of the footwear 200 on the left foot, such that a rearward motion of the right disc 244, or other portions of the footwear 200 on the right foot, exert the rotational force 312 on the left disc 296 to tighten the footwear 200 on the left foot. A mirrored operation can be performed to tighten the footwear 200 on the right foot. In this way, the user is able to quickly adjust the tightness of one or both of the footwear 200, which may be advantageous in circumstances where time is limited, such as during a competition.

It is further contemplated that the release mechanism 324 can be positioned within the midfoot region 110 within the instep region 160 of the sole structure 104 to allow the user to actuate the release mechanism 324 and unlock one foot with the opposite foot, thereby alleviating the need for the user to actuate the release mechanism by hand. As a result, the foregoing operations regarding tightening the footwear 200 can be performed in reverse to loosen the footwear 200. In this way, the user can quickly remove the footwear 200 from one or both feet without bending down and manually handling the footwear 200, which may be advantageous to users who experience difficulty or are prevented from doing so. Further, removing the footwear 200 without manually handling them can promote cleanliness by, e.g., enabling users to quickly unfasten and step out of the footwear 200 before entering a residence.

It is also contemplated that any of discs 244, 296 may be provided with or modified to include a closure mechanism similar to those disclosed and described in U.S. Pat. Nos. 5,325,613; 5,600,875; 5,606,778; 5,638,588; 5,651,198; and 5,669,116, which are all commonly assigned to Puma SE and incorporated by reference in their entirety herein. It is contemplated that the discs 244, 296 may be modified to include the closure mechanisms in place of or in addition to a head to provide further tightening functionality when used with the cord 280 and mounted on the footwear 200 of the present disclosure.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

I claim:

1. An article of footwear, comprising:

an upper attached to a sole structure, the sole structure including a midsole extending within a heel region of the footwear;

a disc that defines a first axis, the disc being positioned in the midsole within the heel region, and the disc having a first surface with a cord retainer and a second surface with a plurality of teeth; and a cord having a first end and a second end, wherein a first tension is configured to be applied to the cord, wherein the first surface is perpendicular to the second surface, wherein the cord retainer includes a post that defines an aperture that is intersected by the first axis, and wherein the post connects to at least one retainer loop, wherein at least one of the first end and the second end of the cord is retained within the at least one retainer loop of the cord retainer, and wherein, when the disc is rotated about the first axis in a first direction, the first tension is applied to the cord and a length of the cord is wrapped around the post of the cord retainer.

2. The article of footwear of claim 1, wherein the plurality of teeth are arranged circumferentially on the disc.

3. The article of footwear of claim 2, wherein the plurality of teeth extend outwardly from the disc.

4. The article of footwear of claim 3, wherein the plurality of teeth are exposed externally of the footwear.

5. The article of footwear of claim 1, wherein the first axis is disposed orthogonal to a central axis that intersects a toe end and a heel end of the footwear.

6. The article of footwear of claim 1, wherein the cord extends through a plurality of eyelets arranged on the upper.

7. An article of footwear, comprising:

an upper attached to a sole structure;

a plurality of eyelets arranged on the upper;

a disc that is disposed within a cavity in the sole structure and defines a first axis, the disc having a cord retainer and a plurality of teeth that protrude outwardly from the cavity;

a release mechanism that is operably connected to the disc; and a cord having a first end and a second end, wherein the cord retainer includes a post that defines an aperture that is intersected by the first axis, and wherein the post connects to at least one retainer loop, wherein at least one of the first end or the second end of the cord is retained within the at least one retainer loop, and wherein, when the disc is rotated about the first axis, the cord is configured to adjust a tightness of the footwear and a length of the cord is wrapped around the post of the cord retainer.

8. The article of footwear of claim 7, wherein the footwear is configured to be unlocked by actuation of the release mechanism.

9. The article of footwear of claim 8, wherein the release mechanism is disposed in the sole structure.

10. The article of footwear of claim 9, wherein the release mechanism protrudes from the sole structure.

11. The article of footwear of claim 7, wherein, when the disc is rotated about the first axis in a first direction, the cord is configured to adjust the footwear to a tightened configuration.

12. The article of footwear of claim 11, wherein further rotation of the disc about the first axis in the first direction causes incremental tightening of the footwear.

13. The article of footwear of claim 11, wherein, when the release mechanism is actuated, the disc is configured to be rotated a second direction about the first axis and the footwear is configured to be adjusted to a loosened configuration.

14. A fastener system for an article of footwear, comprising:

a right shoe, comprising:

a right disc that is disposed within a sole structure and defines a first axis, the right disc having a cord retainer and a plurality of teeth that protrude outwardly from the sole structure, the plurality of teeth extending outwardly from the sole structure along a medial side and a lateral side of the right shoe;

a release mechanism that is operably connected to the right disc; and a cord that is operably secured to the cord retainer; and a left shoe, comprising:

a left disc that is disposed within a sole structure and defines a second axis, the left disc having a cord retainer and a plurality of teeth that protrude outwardly from the sole structure, the plurality of teeth extending outwardly from the sole structure along a medial side and a lateral side of the left shoe;

a release mechanism that is operably connected to the left disc; and a cord that is operably secured to the cord retainer, wherein, when the right disc and the left disc are moved relative to one another, one of the right disc or the left disc is configured to be rotated by engagement with the plurality of teeth of the other of the right disc or left disc, such that a tightness of at least one of the right shoe or the left shoe is adjusted.

15. The fastener system of claim 14, wherein, when the right shoe is moved in a rearward direction, the left disc is configured to adjust the tightness the left shoe.

16. The fastener system of claim 14, wherein the release mechanism of the left shoe is configured to be actuated to unlock the left disc, and wherein the release mechanism of the right shoe is configured to be actuated to unlock the right disc.

17. The fastener system of claim 14, wherein the right disc of the right shoe is configured to be rotated in a first direction about the first axis to adjust the tightness of the right shoe and the left disc of the left shoe is configured to be rotated a second direction about the second axis to adjust the tightness of the left shoe, and wherein the first direction and the second direction are opposite one another.

18. The fastener system of claim 14, wherein each of the right disc and the left disc are disposed within a heel region of the sole structure.

19. The fastener system of claim 18, wherein the release mechanism of the right disc is disposed in the sole structure and forwardly of the right disc, and wherein the release mechanism of the left shoe is disposed in the sole structure and forwardly of the left disc.

* * * * *